US007426943B2

(12) United States Patent
Ueda et al.

(10) Patent No.: US 7,426,943 B2
(45) Date of Patent: Sep. 23, 2008

(54) INDUSTRIAL TWO-LAYER FABRIC

(75) Inventors: Ikuo Ueda, Shizuoka (JP); Hiromi Tsutsue, Shizuoka (JP)

(73) Assignee: Nippon Filcon Co., Ltd., Tokyo (JP)

( * ) Notice: Subject to any disclaimer, the term of this patent is extended or adjusted under 35 U.S.C. 154(b) by 155 days.

(21) Appl. No.: 11/435,095

(22) Filed: May 17, 2006

(65) Prior Publication Data

US 2006/0278295 A1 Dec. 14, 2006

(30) Foreign Application Priority Data

May 19, 2005 (JP) ..... 2005-146726
May 26, 2005 (JP) ..... 2005-153675

(51) Int. Cl.
*D03D 3/04* (2006.01)
*D21F 7/08* (2006.01)
*D03D 11/00* (2006.01)
*D03D 25/00* (2006.01)

(52) U.S. Cl. ..... 139/383 A; 139/384 R; 139/408; 139/410; 162/358.2

(58) Field of Classification Search ..... 139/383 A, 139/384 R, 408, 410, 383 R; 442/203, 205; 162/358.2, 900, 901, 903
See application file for complete search history.

(56) References Cited

U.S. PATENT DOCUMENTS 4,501,303 A * 2/1985 Osterberg ..... 139/425 A
4,729,412 A * 3/1988 Bugge ..... 139/383 A
4,815,499 A * 3/1989 Johnson ..... 139/383 A
4,945,952 A * 8/1990 Vohringer ..... 139/383 A
5,052,448 A * 10/1991 Givin ..... 139/383 A
5,092,372 A * 3/1992 Fitzka et al. ..... 139/383 A
5,454,405 A * 10/1995 Hawes ..... 139/383 A
5,544,678 A * 8/1996 Barrett ..... 139/383 A
5,564,475 A * 10/1996 Wright ..... 139/383 A
5,709,250 A * 1/1998 Ward et al. ..... 139/383 A
5,826,627 A * 10/1998 Seabrook et al. ..... 139/383 A (Continued)

FOREIGN PATENT DOCUMENTS

EP 1365066 11/2003

OTHER PUBLICATIONS

European Search Report dated Sep. 26, 2007 for corresponding European Application No. 06252629.

*Primary Examiner*—Gary L. Welch
*Assistant Examiner*—Bobby Muromoto
(74) *Attorney, Agent, or Firm*—Rader, Fishman & Grauer, PLLC

(57) ABSTRACT

An industrial two-layer fabric includes pairs of warps obtained by stacking an upper side warp to be woven with an upper side weft and a lower side warp to be woven with a lower side weft and having, as at least one of the pairs. A pair of binding warps includes warp binding yarns to be woven with both an upper side weft and a lower side weft constitutes a portion of an upper side surface design and a portion of a lower side surface design. In a lower side surface warp design formed by the weaving of a warp binding yarn and a lower side warp with a lower side weft, two or three designs are different from each other, and a weft passes over two warps adjacent to each other and then passes under a plurality of warps to form a long crimp on the lower side surface.

19 Claims, 17 Drawing Sheets

U.S. PATENT DOCUMENTS 5,881,764 A * 3/1999 Ward ..... 139/383 A
6,581,645 B1 * 6/2003 Johnson et al. ..... 139/383 A
6,810,917 B2 * 11/2004 Stone ..... 139/383 A
6,883,556 B2 * 4/2005 Fahrer et al. ..... 139/383 A
6,896,009 B2 * 5/2005 Ward ..... 139/383 A
6,920,902 B2 * 7/2005 Majaury et al. ..... 139/383 A
6,959,737 B2 * 11/2005 Ward ..... 139/383 A
6,978,809 B2 * 12/2005 Quigley ..... 139/383 A
6,989,079 B2 * 1/2006 Johnson et al. ..... 162/348
7,008,512 B2 * 3/2006 Rougvie et al. ..... 162/348
7,059,359 B2 * 6/2006 Quigley et al. ..... 139/383 A
7,108,020 B2 * 9/2006 Stone ..... 139/383 A
7,114,529 B2 * 10/2006 Johnson et al. ..... 139/383 A
7,124,781 B2 * 10/2006 Fahrer et al. ..... 139/383 A
7,195,040 B2 * 3/2007 Ward ..... 139/383 A
7,219,701 B2 * 5/2007 Ward ..... 139/383 A
7,243,687 B2 * 7/2007 Barratte ..... 139/383 A
7,275,566 B2 * 10/2007 Ward ..... 139/383 A

* cited by examiner

1

2

6

1

2

1

2

1

2

3

1

2

3

1

2

3

6

1

2

INDUSTRIAL TWO-LAYER FABRIC

TECHNICAL FIELD

The present invention relates to an industrial fabric using a warp binding yarn, which fabric can satisfy physical properties required for industrial fabrics such as wear resistance, surface property, rigidity, running stability and water drainage property.

BACKGROUND ART

Fabrics woven with warps and wefts have conventionally been used widely as an industrial fabric. They are used in various fields including papermaking wires, conveyor belts and filter cloths and required to have fabric properties suited for the intended use or using environment. Of such fabrics, a papermaking wire used in a papermaking step for removing water from raw materials by making use of the meshes of a fabric must satisfy severe requirements. There is therefore a demand for the development of fabrics which have an excellent surface property and therefore do not transfer a wire mark of the fabric to paper, have enough wear resistance and rigidity and are therefore usable desirably even under severe environments, and are capable of maintaining conditions necessary for making good-quality paper for a long period of time. In addition, fiber supporting property, improvement in a papermaking yield, good water drainage property, dimensional stability and running stability are required. In recent years, owing to the speed-up of a papermaking machine, requirements for papermaking wires become severe further.

Since most of the requirements for the industrial fabric and how to satisfy them can be understood by describing a papermaking fabric on which the most strict requirement is imposed among industrial fabrics, the present invention will hereinafter be described using the papermaking fabric as a representative example.

It is very important for papermaking fabrics to have, in particular, excellent surface property which does not facilitate transfer of a wire mark of a fabric to paper, fiber supporting property of holding fine fibers, wear resistance permitting long-term running even under strict running conditions, running stability permitting stable running until the final using stage and rigidity. Researches on the design or constitution of a fabric capable of satisfying these properties have been carried out. Two-layer fabrics having, as a portion of an upper side warp and a lower side warp stacked vertically, a warp binding yarn have recently been used as such a fabric. The warp binding yarn has a function of weaving and binding an upper side weft and a lower side weft, and at the same time has, similar to an upper side warp and a lower side warp, a function of forming a portion of an upper side surface and a lower side surface.

A two-layer fabric using a warp binding yarn is disclosed in Japanese Patent Laid-Open No. 2003-342889. This fabric uses a warp binding yarn. Without an additional binding yarn which may break an upper side fabric design, it has an excellent surface property. It is superior in binding strength to a fabric bound via a weft. The fabric described in this document, however, adopts a design in which a lower side weft constituting the lower side surface passes over two warps and then passes under two warps to form a short weft crimp corresponding to two lower side warps on the lower side surface. This fabric has a water drainage space between two adjacent pairs of lower side warps and is made of yarns with a small diameter so that it is suited as a fabric for the manufacture of tissue paper having a thin wire thickness. This fabric is suited as a fabric for manufacturing tissue paper, but is not suited for applications requiring wear resistance and rigidity. A lower side weft having a long crimp design is able to have improved wear resistance, but in a fabric using a warp binding yarn, the fabric design is sometimes limited by the diameter of a yarn, or structure or application of the resulting fabric. For example, even if a large-diameter yarn is used as the lower side weft of this fabric in order to increase its wear resistance, the lower side weft becomes unpliable and a warp appearing from the lower side tends to protrude and be worn away.

As described above, no industrial fabric using a warp binding yarn so far developed can simultaneously satisfy wear resistance, surface property, rigidity, running stability and water drainage property.

SUMMARY OF THE INVENTION

An object of the present invention is to provide an industrial two-layer fabric satisfactory in any one of surface property, wear resistance, rigidity, running stability and water drainage property necessary for industrial fabrics.

The present invention relates to an industrial two-layer fabric comprising pairs of warps obtained by vertically stacking an upper side warp to be woven with an upper side weft and a lower side warp to be woven with a lower side weft and having, as at least one of the pairs, a pair of binding warps composed of warp binding yarns to be woven with both an upper side weft and a lower side weft to constitute a portion of an upper side surface design and a portion of a lower side surface design. The fabric of this invention has, as a lower side surface warp design formed by the weaving of a warp binding yarn and a lower side warp with a lower side weft, two or three designs different from each other and has, as a weft design, a design of passing over two warps adjacent to each other and then passing under a plurality of warps to form a long crimp on the lower side surface.

In the industrial two-layer fabric of this invention, warp binding yarns forming the pair may be constituted to appear alternately from the upper side surface and may be woven with respective upper side wefts, which are different from each other, to cooperatively function as a warp constituting the upper side surface design, while on the lower side surface, the warp binding yarns forming the pair may appear alternately from the lower side surface and may be woven with respective lower side wefts which are different from each other.

The warp binding yarns forming the pair may have a design in which one of the warp binding yarns of the pair is woven with an upper side weft, under which the other warp binding yarn is woven with at least one lower side weft, while the one of the warp binding yarns is woven with at least one lower side weft, over which the other warp binding yarn is woven with an upper side weft. In this case, the pair of the warp binding yarns complement each other to constitute, on both the upper side surface and lower side surface, a design corresponding to a warp.

A warp binding yarn may have a design which is bilaterally symmetrical relative to one or two lower side knuckles each formed by passing of the warp binding yarn under a lower side weft, and at the same time a warp design on the lower surfaced side formed by the pair of binding warps is obtained by repeating a design of passing over a plurality of lower side wefts and then passing under a lower side weft.

The warp binding yarns forming the pair may have the same design or have designs in which one is a mirror image of the other.

The warp design on the lower side formed cooperatively by the pair of binding warps may have a 3/1 design of passing over three lower side wefts and then passing under a lower side weft. In this case, a lower side weft design constituting the lower side surface may be a design of passing over two warps on the lower side and then passing under six successive warps on the lower side. Additionally, the two different warp designs on the lower side surface may comprise a 4/1-2/1 design of passing over four lower side wefts, passing under a lower side weft, passing over two lower side wefts and passing under a lower side weft and a 3/1 design of passing over three lower side wefts and passing under a lower side weft, while a weft design is a design of passing over two successive warps on the lower side and then passing under six successive warps on the lower side. Alternatively, three different warp designs on the lower side may comprise a 4/1-2/1 design of passing over four lower side wefts, passing under a lower side weft, passing over two lower side wefts and passing under a lower side weft, a 3/1 design of passing over three lower side wefts and passing under a lower side weft, and a 5/1-1/1 design of passing over five lower side wefts, passing under a lower side weft, passing over a lower side weft and passing under a lower side weft, while a weft design is a design of passing over two successive warps on the lower side and then passing under six successive warps on the lower side.

The warp design on the lower side formed cooperatively by the pair of binding warps of this invention may be a 4/1 design of passing over four lower side wefts and then passing under a lower side weft, while the lower side weft design forming the lower side surface is a design of passing over two successive warps on the lower side and then passing under eight successive warps on the lower side.

In this case, the two different warp designs on the lower side surface may be a 6/1-2/1 design of passing over six lower side wefts, passing under a lower side weft, passing over two lower side wefts and passing under a lower side weft and a 4/1 design of passing over four lower side wefts and passing under a lower side weft, while the weft design is a design of passing over two successive warps on the lower side and then passing under eight successive warps on the lower side.

The pair of binding warps may be sandwiched between pairs of warps.

On the lower side surface, two warps adjacent to each other may weave a lower side weft from the lower side, whereby the lower side weft forms a weft long crimp corresponding to a plurality of warps on the lower side surface, and all the warps forming the lower side surface each forms zigzag arrangement while approaching two warps, which are adjacent thereto on the right and left sides, alternately at a portion in which the warp weaves a lower side weft from the lower side.

The upper side surface design formed by weaving of a warp binding yarn and an upper side warp with an upper side weft may be composed of a single warp design. Further, the upper side surface design formed by weaving of a warp binding yarn and an upper side warp with an upper side weft may be obtained by alternately disposing two warp designs different from each other.

The industrial two-layer fabric of the present invention is able to have an excellent surface property by adopting two or three different warp designs for the lower side surface design formed by weaving of a warp binding yarn and a lower side warp with a lower side weft and adopting for warp binding yarns forming a pair a design bilaterally symmetrical relative to a lower side knuckle, more preferably the same design.

Figure 1:
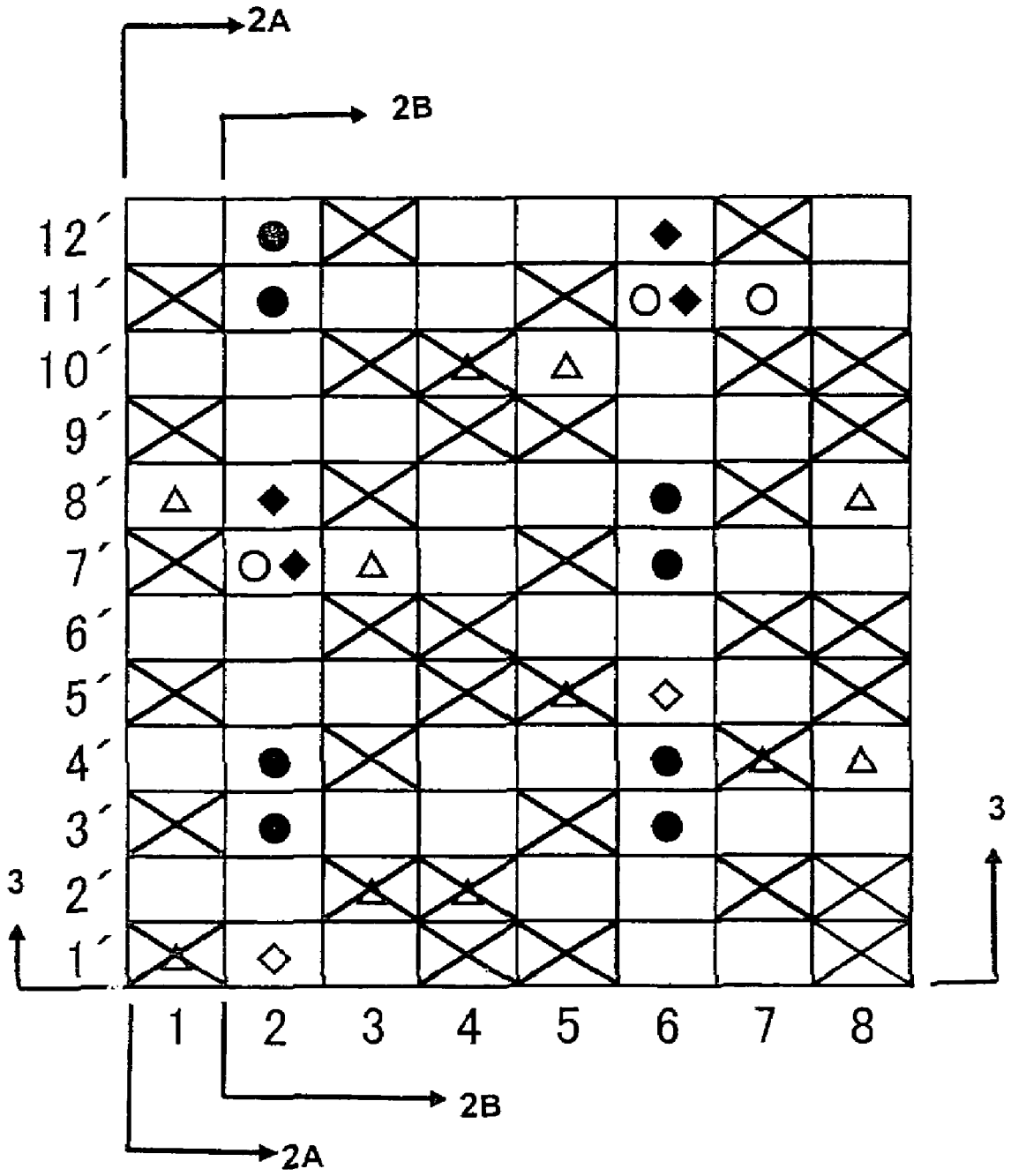
FIG. 1 is a design diagram showing a repeating unit of an industrial two-layer fabric of Example 1 according to the present invention.

In the figures, the numerals of 1, 2, 3 . . . 10 denote warp pairs or binding warp pairs, and the numerals of 1' to 32' denote upper side wefts and lower side wefts.

DETAILED DESCRIPTION OF THE INVENTION

The industrial fabric of the present invention is a two layer fabric having upper side warps to be woven with upper side wefts and lower side warps to be woven with lower side wefts. An upper side warp and a lower side warp always form a pair and are stacked almost vertically one after another and form a "pair of warps". At least one of the pairs of warps is a "pair of binding warps" composed of two warp binding yarns which are woven with both an upper side weft and a lower side weft to constitute a portion of the upper side surface design and a portion of the lower side surface design. This industrial two-layer fabric is characterized in that on a warp design a lower side formed by weaving of a warp binding yarn and a lower side warp with a lower side weft is composed of two or three warp designs different from each other and as a weft design, a design in which a lower side weft passes over two adjacent warps and then passes under a plurality of warps to form a long crimp on the lower side surface.

Warp binding yarns are woven with both an upper side weft and a lower side weft to constitute a portion of the upper side surface design. It is preferred that two warp binding yarns alternately appear from the upper side surface and are woven with respective upper side wefts different from each other to cooperatively function as a warp constituting the upper side surface design. When a design in which warp binding yarns forming a pair pass over the same upper side weft is adopted, these two warp binding yarns are juxtaposed on one upper side weft, which occludes a water drainage space, disturbs uniform water drainage property, and becomes a cause for generation of marks. For the same reason, a good result is available by adopting for the lower side surface a design in which two warp binding yarns are woven with respective lower side wefts different from each other.

In the present invention, the term "warp on the upper side" embraces both an upper side warp and a warp binding yarn forming a pair to constitute the upper side surface design, while the term "warp on the lower side" embraces both a lower side warp and a warp binding yarn forming a pair to constitute the lower side surface design.

Pairs of warps and pairs of binding warps are arranged at a desired ratio. When binding strength is required, a ratio of the pairs of binding warps may be increased or even only pairs of binding warps may be used. In other cases, a ratio of the pairs of warps may be increased over the pairs of binding warps. In a fabric using a warp binding yarn, no additional binding yarn exists so that the resulting fabric has a dense surface and does not gene-rate marks. In addition, a binding yarn does not become loose during using so that no internal wear occurs.

The fabric has two or three warp designs different from each other on the lower side surface and a lower side weft has a design of passing over two warps adjacent to each other and then passing under a plurality of warps to form a long crimp on the lower side surface. In the present invention, there are two warps for forming the lower side surface, that is, a lower side warp and a warp binding yarn forming a pair. A design suited for each of the upper side surface and lower side surface cannot be formed by only one warp binding yarn, but a design similar to that formed by an upper side warp and a lower side warp can be formed by cooperation of two warp binding yarns. In such a manner, two or three warp designs different from each other are formed by a pair of warp binding yarns and a lower side warp.

In the present invention, the term "three warp designs different from each other on the lower side" means that a lower side surface design is composed of three designs different from each other, for example, warp 1 on the lower side having a 3/1 design in which passing under a lower side weft and over three lower side wefts is repeated; warp 2 on the lower surface having a 4/1-2/1 design in which the warp passes over four lower side wefts, passes under a lower side weft, passes over two lower side wefts and passes under a lower side weft; and warp 3 on the lower side having a 5/1-1/1 design in which the warp passes over five lower side wefts, passes under a lower side weft, passes over a lower side weft and passes under a lower side weft. The warp 1, warp 2 and warp 3 on the lower side may be either a lower side warp or a warp binding yarn forming a pair. In this case, the lower side surface design formed by the pair of binding warps is preferably repetition of a 3/1 design in which binding warps as the pair always pass over or under the same number of lower side wefts because a warp binding yarn preferably has a bilaterally symmetric design relative to a lower side knuckle. A lower side warp may be any one of a 3/1 design, 4/1-2/1 design or 5/1-1/1 design, or may be a combination of a 3/1 design with a 3/1-2/1-3/1-4/1 design or a combination of a 3/1 design with a 3/1-5/1-3/1-1/1 design. A fabric which is uniform in the knuckle height and dent depth at intersection and thus has an excellent surface property while having a weft long crimp on the lower side surface can be obtained by adopting three warp designs different from each other. The term "two warp designs different from each other on the lower side surface" has the same meaning as described above.

Whether to adopt two warp designs or three warp designs for the lower side may be selected as needed depending on the number of shafts of the fabric, combination of designs or arrangement of binding warps. The number of warp designs on the lower side greater than 3 is not preferred because a uniform fabric design cannot easily be formed and deterioration in surface property sometimes occurs.

For a lower side weft, a design in which it passes over two warps adjacent to each other and then passes under a plurality of warps to form a long crimp on the lower side surface is employed. The design of forming a weft long crimp on the lower side makes it possible to obtain a weft wear type fabric excellent in wear resistance. In addition, by adopting a design in which two warps on the lower side, which are adjacent to each other, simultaneously weave a lower side weft, the lower side weft long crimp protrudes further from the surface, which improves both wear resistance and rigidity of the resulting fabric. Moreover, on the lower side surface, two warps adjacent to each other weave a lower side weft from the lower side, whereby all the warps forming the lower side surface each forms zigzag arrangement while approaching alternately warps adjacent thereto on the right and left sides at a portion where they weave a lower side weft from the lower side. By this zigzag arrangement, the fabric has improved rigidity in the diagonal direction and there exist both an overlap portion and a non-overlap portion of a warp on the upper side with a warp on the lower side. Since meshes with a random size or shape can be formed, stepwise dehydration can be carried out, making it possible to prevent generation of dehydration marks, sticking of a sheet raw material onto a wire or removal of fiber or filler from the wire.

An example of the zigzag arrangement will next be described. In the lower side layer where warp pairs and binding warp pairs are arranged as needed, a rower side weft is woven simultaneously by two warps adjacent to each other and thereby forms a long crimp. In other words, two warps on the lower side, which are adjacent to each other, simultaneously pass under a lower side weft. When lower side warps are designated as warps 1, 2 and 3, warp 2 is, together with warp 1 adjacent thereto, woven with lower side weft 1'. Warp 2 is, together with warp 3 adjacent thereto, woven with lower side weft 7'. Two warps on the lower side, which are adjacent to each other, approach at a portion where they are woven with a lower side weft. In other words, warps 1 and 2 on the lower side approach each other by weaving with lower side weft 1', while warps 2 and 3 on the lower side approach each other by weaving with lower side weft 7'. Warp 2 on the lower side approaches on the warp 1 side at the intersection with lower side weft 1' and approaches on the warp 3 side at the intersection with lower side weft 7'. Then, lower surface wide warp 2 travels from side to side and therefore exhibits zigzag arrangement. Other warps on the lower side also exhibit zigzag arrangement.

Warp binding yarns forming a pair each preferably has a bilaterally symmetrical design relative to one or two lower side knuckles each formed by passing of the warp binding yarn under a lower side weft. When both of these two warp binding yarns have a symmetrical design, the resulting fabric has an excellent surface property because dent depths at the intersection between the warp binding yarns become uniform. The term "symmetrical design" herein also embraces the case where the design is not completely symmetrical owing to an arrangement ratio of upper side wefts and lower side wefts. The warp binding yarns forming a pair preferably have the same design or have designs in which one is a mirror image of the other. The latter design is different from the former one only in the direction of the design. By employing such a design, warp binding yarns forming a pair become equal in pulling-in strength of an upper side weft and the height of a knuckle becomes uniform, whereby a fabric with excellent surface property can be obtained. In addition, the dent depth at the intersection between warp binding yarns becomes uniform and the resulting fabric has an excellent surface property. Similar to the above-described case, owing to an arrangement ratio of upper side wefts and lower side wefts, however, the design is sometimes not completely the same in the design diagram, but inevitable misalignment of a weft owing to the structure of a fabric is also embraced in the same design. When a warp binding yarn is not bilaterally symmetrical relative to a lower side knuckle or two warp binding yarns forming a pair have different designs, the heights of knuckles of a warp binding yarn passing over an upper side weft differ each other and dent depths at the intersections of warp binding yarns forming a pair become different, which undesirably becomes a cause of transfer of marks to paper. As described above, when a warp on the lower side has three designs, that is, a 4/1-2/1 design, a 3/1 design and a 5/1-1/1 design, and a binding warp pair has a 4/1-2/1 design, two warp binding yarns each cannot have a bilaterally symmetrical design relative to a lower side knuckle. In addition, warp binding yarns forming a pair cannot have the same design. The binding warp pair therefore preferably has repetition of a design such as 3/1 design of passing over and under the same number of lower side wefts. On the other hand, lower side warps may have any one of a 3/1 design, 4/1-2/1 design or 5/1-1/1 design. In order to form a specific fabric design as that in the present invention, it is necessary to fully consider the warp designs, combination thereof, and shifting manner of them.

On the upper side surface, an auxiliary weft having a smaller diameter than an upper side weft may be disposed between upper side wefts. For example, it is effective for improving the fiber supporting property of a weft by alternately disposing an upper side weft and an auxiliary weft to form a long crimp in which the auxiliary weft passes over a plurality of warps.

Warps constituting the upper side surface design are warp binding yarns forming a pair with an upper side warp and they are woven with upper side wefts. No particular limitation is imposed on the upper side fabric design, and any design selected from plain weave, twill weave, broken twill weave, satin weave or the like fabric design may be employed. An upper side surface design may be that obtained by using not only one design but also two designs for warps on the upper side and alternately disposing these two different warp designs. The upper side surface design is, for example, a design in which a warp forming plain weave and a warp having a design of passing over an upper side weft and then passing under three upper side wefts are disposed alternately. This design can introduce therein the advantages of these designs such as rigidity of the plain weave design and air permeability of a 1/3 design and in addition, defects of them such as lowering in the limit of the shooting number and worsening of diagonal rigidity can be eliminated.

The number of upper side wefts and lower side wefts may be made equal or different. For example, upper side wefts and lower side wefts may be arranged at a ratio of 1:1. The ratio may be any one of 2:1, 3:2 or 4:3. In the field of a papermaking fabric, a ratio of upper side wefts may be preferably greater because a dense upper side surface is preferred from the viewpoints of the fiber supporting property and surface property.

Although there is no particular limitation is imposed on the diameter of yarns, upper side wefts and upper side warps constituting the upper side surface have preferably a relatively smaller diameter in order to form a dense and smooth surface. When the surface property of a fabric is particularly important, use of warp binding yarns equal to upper side warps in diameter are preferred. A difference in diameter between upper side warps and warp binding yarns sometimes gives wire marks to paper because yarns of a greater diameter protrude from the upper side surface. When upper side warps and warp binding yarns are equal in diameter, the heights of knuckles of warps on the upper side become almost equal, leading to the formation of a relatively uniform surface. The fabric having lower side warps and warp binding yarns equal in diameter is preferred for the application requiring wear resistance.

The lower side surface to be brought into contact with machine or roll requires rigidity and wear resistance so that lower side wefts and lower side warps preferably have a relatively large diameter. In the field of paper making fabrics, fabrics satisfying both the surface property and wear resistance can be obtained by using upper side warps and warp binding yarns equal in diameter and lower side warps and lower side wefts having a greater diameter than the above-described two. In this case, at a portion where a warp binding yarn passes under a lower side weft, there is a fear of the warp binding yarn of a smaller diameter being worn away because it appears from the lower side surface. When binding warp pairs are sandwiched between warp pairs, and at a portion where a warp binding yarn passes under a lower side weft, a lower side warps adjacent to the warp binding yarn has a design of passing under the same lower side weft, the warp binding yarn which has a smaller diameter does not protrude so much as the lower side warp having a greater diameter. As a result, it is not worn away prior thereto and the fabric can be used without being disturbed by the breakage of the warp binding yarn. All the warps may have the same diameter.

The lower side surface of the present invention has two or three warp designs on the lower side which are different from each other, and a weft design in which a lower side weft passes over two warps adjacent to each other, and passes under a plurality of warps to form a long crimp on the lower side surface. Satisfactory investigation on the design and arrangement of warps on the lower side is necessary in order to employ such designs. The warp pairs and binding warp pairs may be arranged at an equal ratio or a different ratio. In addition, it is preferred that a warp binding yarn has a bilaterally symmetrical design relative to a lower side knuckle formed by the warp binding yarn passing under a lower side weft or warp binding yarns forming a pair have the same design. Which warp pair is replaced by a binding warp pair may be determined after due consideration of such conditions.

Yarns to be used in the present invention may be selected depending on the using purpose. Examples of them include, in addition to monofilaments, multifilaments, spun yarns, finished yarns subjected to crimping or bulking such as so-called textured yarn, bulky yarn and stretch yarn, and yarns obtained by intertwining them. As the cross-section of the yarn, not only circular form but also square or short form such as stellar form, or elliptical or hollow form can be used. The material of the yarn can be selected freely and usable examples of it include polyester, nylon, polyphenylene sulfide, polyvinylidene fluoride, polypropylene, aramid, polyether ether ketone, polyethylene naphthalate, cotton, wool and metal. Of course, yarns obtained using copolymers or incorporating or mixing the above-described material with a substance selected depending on the intended purpose may be used.

As upper side warps, lower side warps, warp binding yarns and upper side effects of a paper making wire, polyester monofilaments having rigidity and excellent size stability are usually suited. As lower side wefts which require wear resistance, those obtained by interweaving a polyester monofilament and a polyamide filament, for example, by disposing them alternately are preferred because the fabric using such a weft has improved wear resistance while maintaining rigidity.

EXAMPLES

Referring to accompanying drawings, embodiments of the present invention will next be described based on some Examples.

Figure 20A:
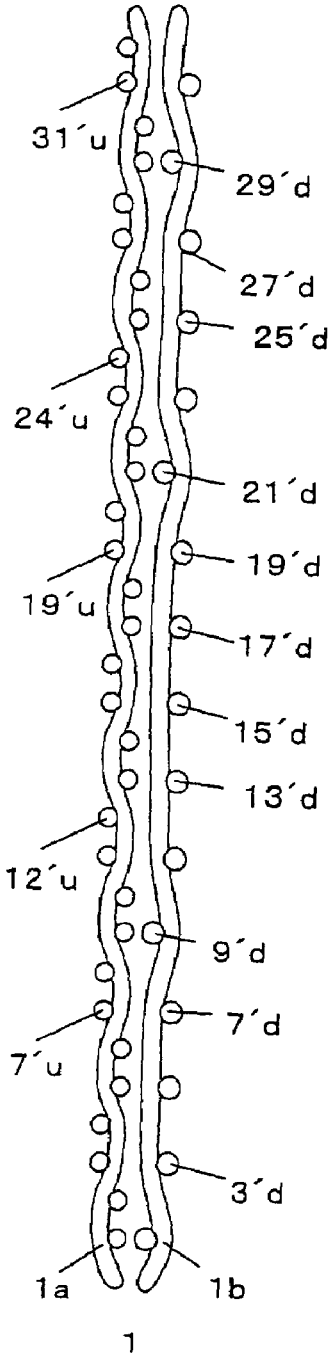
FIGS. 20A, 20B and 20C include cross-sectional views taken along the lines 20A-20A, 20B-20B and 20C-20C at warp pair 1, warp binding yarn pair 2 and warp pair 3 illustrated in FIG. 19 respectively.
Figure 20B:
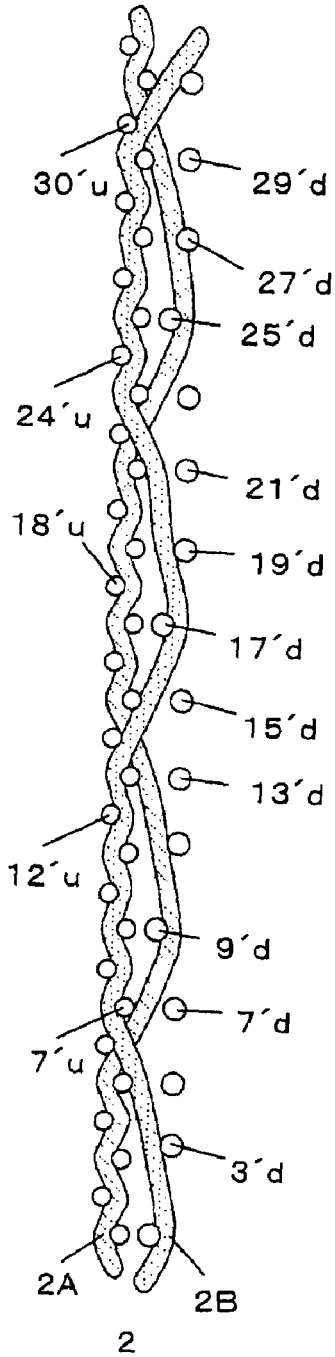
Figure 20C:
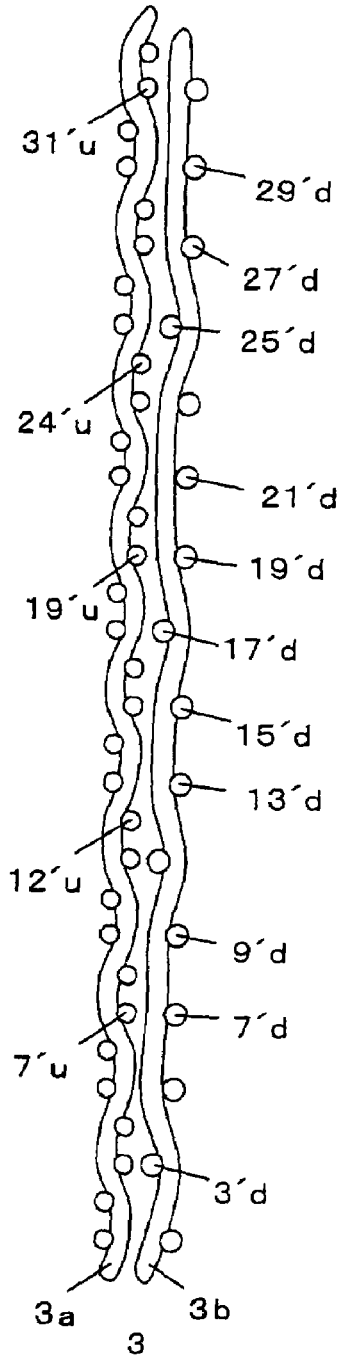
Figure 21:
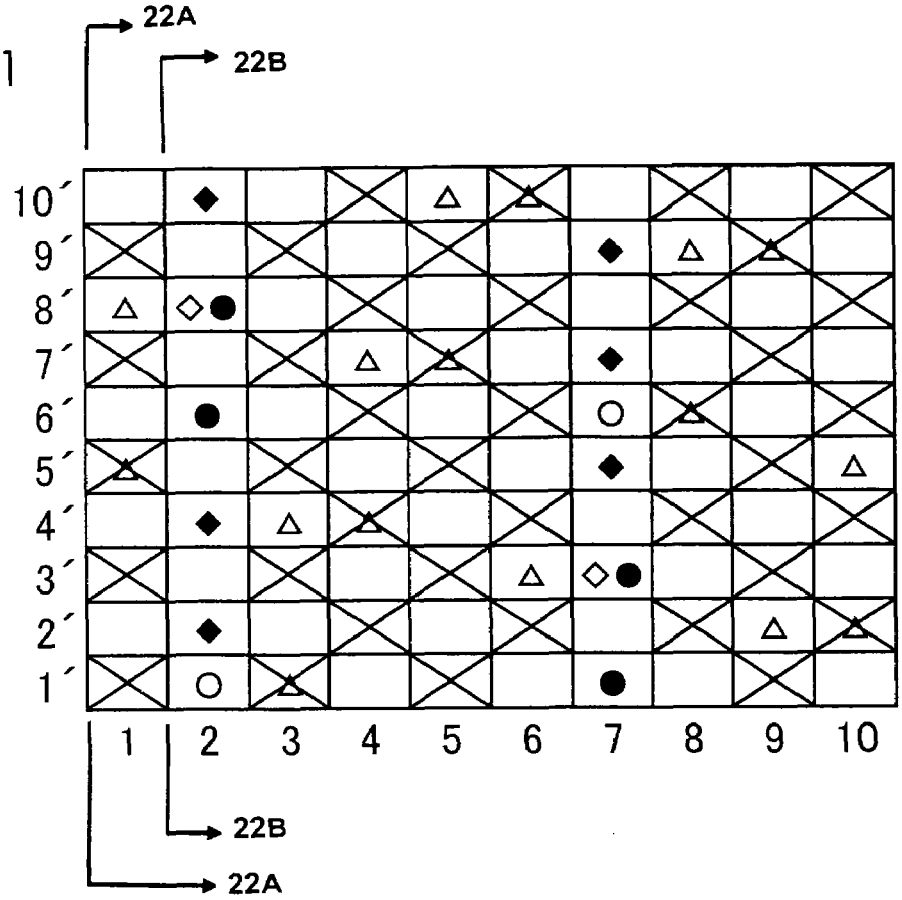
FIG. 21 is a design diagram showing a repeating unit of an industrial two-layer fabric of Conventional Example 1.

FIGS. 1 to 20 are design diagrams, cross-sectional view taken along a warp and cross-sectional view taken along a weft, each of the fabrics obtained in Examples of the present invention. FIGS. 21 and 22 illustrate a conventional example, in which FIG. 21 is a design diagram of the conventional example and FIG. 22 is a cross-sectional view taken along a warp of FIG. 21.

A complete design which is a minimum repeating unit of a fabric design is shown in each design diagram and a whole fabric design is formed by connecting this complete design longitudinally and latitudinally. In the design diagram, warps are indicated by Arabic numerals, for example 1, 2 and 3, of which some are warp pairs composed of upper side warp and lower side warp and some are binding warp pairs composed of two warp binding yarns. Wefts are indicated by Arabic numerals with a prime, for example, 1', 2' and 3'. Some of them have an upper side weft and a lower side weft stacked vertically and some are composed only of an upper side weft, which is determined depending on the arrangement ratio.

In these diagrams, a mark "x" means that an upper side warp lies over an upper side weft; a mark "Δ" indicates that a lower side warp lies under a lower side weft; a mark "♦" indicates that a warp binding yarn lies over an upper side weft; a mark "◇" indicates that a warp binding yarn lies under a lower side weft; a mark "●" indicates that a warp binding yarn lies over an upper side weft; and a mark "○" indicates that a warp binding yarn lies under a lower side weft.

Upper side warps and upper side wefts vertically overlap with lower side warps and lower side wefts, respectively. With regards to wefts, some upper side wefts do not have a lower side weft thereunder because of the arrangement ratio.

In the design diagram, yarns are vertically overlapped precisely. They are however illustrated as such for convenience of drawing and misalignment is allowed in the actual fabric. Two warp binding yarns forming a pair cooperatively function as one warp constituting an upper side complete design on the upper side surface. This also applies to the lower side fabric.

Conventional Example 1

Figure 22A:
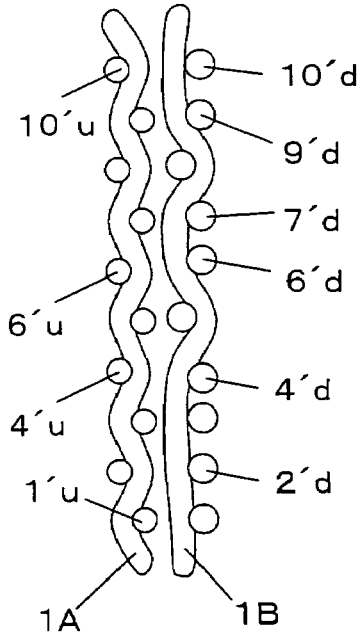
FIGS. 22A and 22B are cross-sectional views taken along the lines 22A-22A and 22B-22B at warp pair 1 and warp binding yarn pair 2 illustrated in FIG. 21.
Figure 22B:
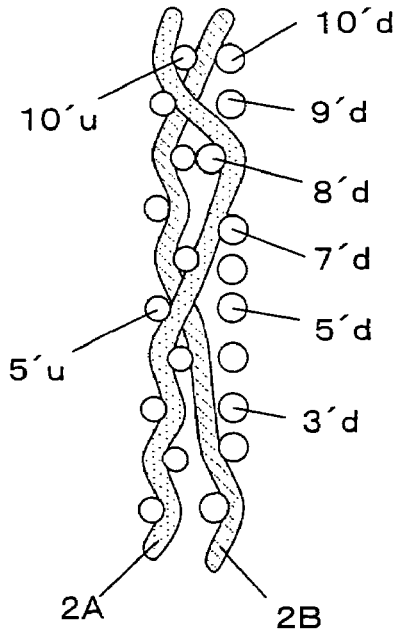

FIG. 21 is a design diagram showing a repeating unit of a fabric of Conventional Example 1. FIGS. 22A and 22B are a cross-sectional view illustrating the warp pair 1 and binding warp pair 2 of the design diagram of FIG. 21 respectively. This fabric is a 20-shaft two-layer fabric having binding warp pairs arranged at a ratio of 2/10. In this fabric, upper side wefts and lower side wefts are arranged at a ratio of 1:1.

In the design diagram of FIG. 21, indicated at numerals 2 and 7 are binding warp pairs each composed of two warp binding yarns, while indicated at numerals 1, 3, 4, 5, 6, 8, 9 and 10 are warp pairs each composed of an upper side warp and a lower side warp. The lower side surface has one warp design, that is, a 6/1-2/1 design in which a warp on the lower side passes over six lower side wefts, under a lower side weft, over two lower side wefts and under a lower side weft. In order to improve the wear resistance, a design in which a lower side weft passes over two warps on the lower side and then passes under eight warps on the lower side is employed for the lower side surface. Although a long crimp of a lower side weft can be formed in this fabric, it is impossible to employ, for warp binding yarns forming a pair, the same design which is bilaterally symmetric relative to a lower side knuckle formed when they pass under a lower side weft. Even if one of the warp binding yarns has a bilaterally symmetrical design, the other one does not have a bilaterally symmetrical design. As a result, the knuckles formed when the warp binding yarns pass over an upper side weft have different heights and also different dent depths at the intersections between two warp binding yarns, leading to a fabric with clear marks. In particular, the dent depths at the intersections provide paper with marks.

As is apparent from FIG. 22B which is a cross-sectional view of the conventional example 1 taken along a warp, warp binding yarns 2A and 2B of the pair 2 are each not bilaterally symmetrical relative to a lower side knuckle formed by their passing under a lower side weft. Warp binding yarn 2A has a design in which it passes under upper side weft 1'*u*, over 2'*u*, under 3'*u*, and over 4'*u*, heads to the lower side, passes under lower side weft 8'*d*, heads to the upper side, and passes over upper side weft 10'*u*. In other words, on one side relative to lower side weft 8'*d*, warp binding yarn 2A passes between three upper side wefts and lower side wefts, while on the other side, it passes between one upper side weft and lower side weft. Thus, this design is not bilaterally symmetrical.

Warp binding yarn 2B also has a design in which it passes under lower side weft 1'*d*, heads to the upper side, passes over upper side weft 6'*u*, under 7'*u* and over 8'*u* and then heads to the lower side. In other words, on one side relative to lower side weft 1'*d*, warp binding yarn 2B passes between four upper side wefts and lower side wefts, while on the other side, it passes between two upper side wefts and lower side wefts. Thus, this design is not bilaterally symmetrical. Since warp binding yarns 2A and 2B do not have the same design, they are different in the height of a knuckle and dent depth at an intersection.

The fabric of the Conventional Example 1 has such an upper side surface so that it is not expected to have an excellent surface property with fewer marks. Examples will next be examined based on the above-described findings.

Example 1

Figure 2A:
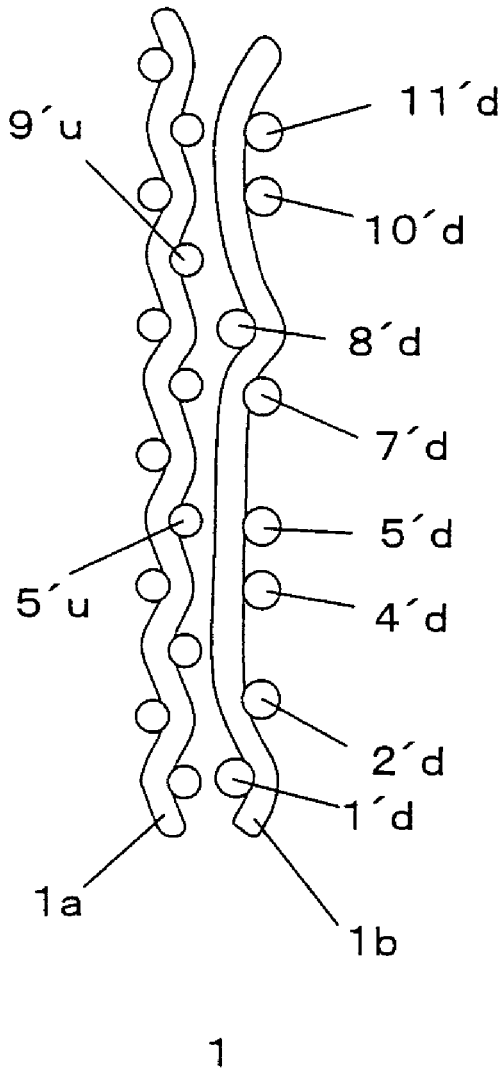
FIGS. 2A and 2B include cross-sectional views taken along the lines 2A-2A and 2B-2B at warps of warp pair 1 and warp binding yarn pair 2 illustrated in FIG. 1 respectively.
Figure 2B:
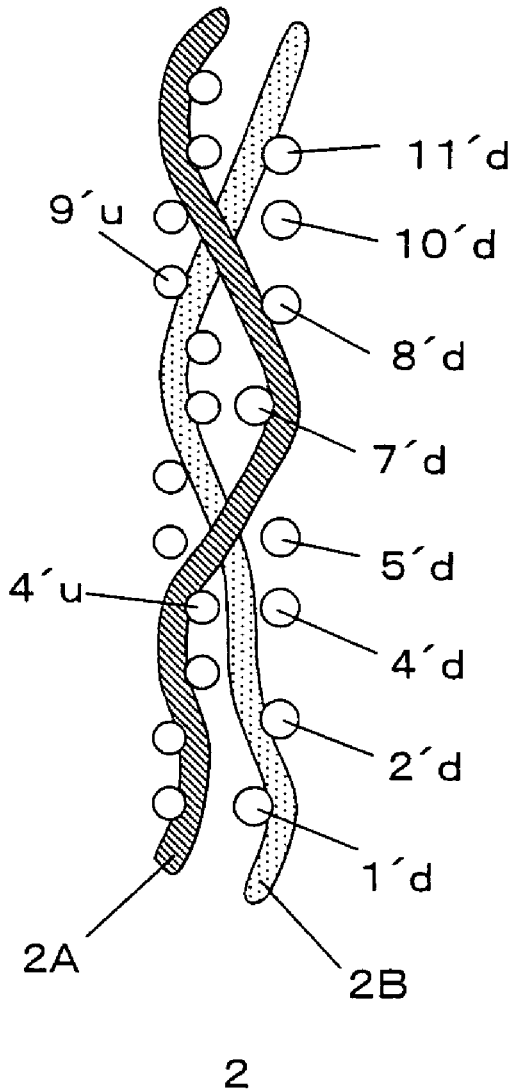
Figure 3:
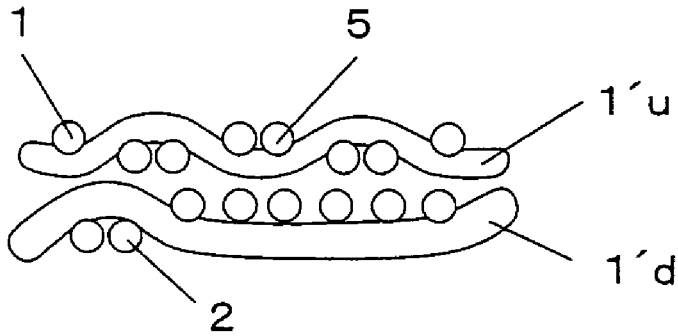
FIG. 3 is a cross-sectional view taken along the line 3-3 at vertically stacked wefts of weft 1 illustrated in FIG. 1.

FIG. 1 is a design diagram showing a repeating unit of a fabric of Example 1 of the present invention. FIGS. 2A and 2B include cross-sectional views of warp pair 1 and binding warp pair 2 illustrated in the design diagram of FIG. 1 along the lines 2A-2A and 2B-2B respectively. FIG. 3 is a cross-sectional view taken along the line 3-3 at weft pair 1' illustrated in the design diagram of FIG. 1 and having an upper side weft and a lower side weft stacked vertically. The fabric is a 16-shaft two-layer fabric having binding warp pairs arranged at a ratio of 2/8. Its upper side surface design and lower side surface design are each composed of two designs different from each other and upper side wefts and lower side wefts are arranged at a ratio of 3:2.

In the design diagram of FIG. 1, indicated at numerals 2 and 6 are binding warp pairs each composed of two warp binding yarns, while indicated at numerals 1, 3, 4, 5, 7 and 8 are warp pairs each composed of an upper side warp and a lower side warp. The binding warp pairs for weaving upper and lower layers therewith are arranged at a ratio of 2/8. A sufficient binding strength can be attained at such an arrangement ratio.

One of the warp binding yarns forming a pair is woven with an upper side weft to form the upper side surface design, while the other warp binding yarn is woven with at least one lower side weft to form the lower side surface design. In other words, in a portion where one of the warp binding yarns forms the lower side surface design, the other warp binding yarn forms the upper side surface design and in a portion where the one of the warp binding yarns forms the upper side surface design, the other warp binding yarn forms the lower side surface design. In such a manner, two warp binding yarns complement each other to form the upper side surface design and the lower side surface design.

The lower side surface has two different warp designs. Warps 1, 3, 4, 5, 7 and 8 on the lower side each has a 4/1-2/1 design in which each of the warps passes over four lower side wefts, under a lower side weft, over two lower side wefts and under a lower side weft, while warps 2 and 6 each has a 3/1 design in which passing over three lower side wefts and under a lower side weft is repeated. Warps 2 and 6 are pairs of binding warps. By forming a pair, it functions as a lower side warp and forms the design similar to other lower side warps. Lower side wefts each has a design in which it passes over two warps on the lower side which are adjacent to each other and then passes under six successive warps on the lower side to form a weft long crimp on the lower side surface. The fabric has excellent wear resistance owing to the employment of a design of forming a weft long crimp on the lower side. Lower side wefts are each woven by two warps adjacent to each other from the lower side so that the resulting fabric has improved rigidity and in addition, the long crimp protruding from the lower side increases a wear resistant volume so that the fabric can have excellent wear resistance.

Two warp designs different from each other are alternately disposed on the upper side surface. Warps 1, 3, 5 and 7 on the upper side each has a 1/1 design in which passing over an upper side weft and under an upper side weft is repeated. Warps 2, 4, 6 and 8 on the upper side each has a 2/2 design in which passing over two upper side wefts and under two upper side wefts is repeated. As in the above-described lower side surface design, warps 2 and 6 are binding warp pairs, but similar to the other upper side warps, they function and form the design as an upper side warp.

In the present example, warp binding yarns forming a pair have respective designs different from each other. According to the cross-sectional view of warp binding yarn 2 in FIG. 2B, warp binding yarn 2A has a design in which it passes under upper side wefts 1'*u* and 2'*u*, passes over upper side wefts 3'*u* and 4'*u*, heads to the lower side, passes under lower side weft 7'*d*, heads to the upper side, and passes over upper side wefts 11'*u* and 12'*u*. On the other hand, warp binding yarn 2B has a design in which it passes under lower side weft 1'*d*, heads to the upper side, passes over upper side wefts 7'*u* and 8'*u* and then heads to the lower side. They are different designs, but by using them in combination, a 2/2 design is formed on the upper side surface and a 3/1 design is formed on the lower side surface. Warp binding yarns 2A and 2B are each bilaterally symmetrical relative to a lower side knuckle. Since upper side wefts and lower side wefts are arranged at a ratio of 3:2, they are not completely symmetrical. Owing to the design of a fabric, lower side weft 7'*d* sometimes approaches on the 8'*d* side and the design becomes substantially symmetrical. By adopting such a bilaterally symmetrical design for warp binding yarns forming a pair, the dent depth at the intersection of warp binding yarns forming a pair can be made uniform. Described specifically, a portion of warp binding yarn 2A pulling upper side wefts 3'*u* and 4'*u* toward the lower side and a portion of it pulling upper side wefts 11'*u* and 12'*u* toward the lower side become equal in height. Since warp binding yarn 2B also has a bilaterally symmetrical design relative to a lower side knuckle, a portion of it pulling upper side wefts 7'*u* and 8'*u* toward the lower side and a portion of it pulling upper side wefts 7'*u* and 8'*u* of the following cycle toward the lower side become equal in height. As a result, a uniform dent depth appears at the intersection of warp binding yarns 2A and 2B between wefts 4'*u* and 5'*u* and wefts 10'*u* and 11'*u* and the resulting fabric can have excellent surface uniformity as a whole fabric.

By sandwiching the binding warp pair between two warp pairs, the lower side wear of a warp binding yarn having a relatively small diameter can be reduced. Warps forming the lower side surface are a lower side warp and a warp binding yarn and two warps on the lower side which are adjacent to each other pass under the same lower side weft. In the design diagram of the present example, there exist two lower side knuckles at which lower side warp and warp binding yarn both pass under a lower side weft. When a machine is brought into contact with the lower side surface, a lower surface wide warp does not wear out easily even if it is brought into contact with the machine or roll because it has a greater diameter. When the diameter of a warp binding yarn is greater than it, the resulting fabric sometimes becomes unusable because the lower side knuckle of the warp binding yarn is brought into contact with the machine or roll and the warp binding yarn wears out. In the design of the present example in which a warp binding yarn and a lower side warp, which is adjacent thereto at a portion where the warp binding yarn passes under a lower side weft, pass under the same lower side weft, on the other hand, the warp binding yarn having a small diameter does not wear out prior to the lower side warp having a greater diameter owing to the protrusion of the lower side warp. As a result, use of the fabric is not disturbed by the breakage of a warp binding yarn.

Described specifically, at a portion where warp binding yarn 2A passes under lower side weft 7'*d* as shown in FIG. 1 with "○", warp binding yarn 2A exists on the lower side surface closest to a roll so that it is easily worn away by rubbing with the roll. Lower side warp 3, adjacent to warp binding yarn 2A, however, has a design in which it passes under the same lower side weft 7'*d* (as shown in FIG. 1 with "Δ") to form a lower side knuckle so that warp binding yarn 2A and lower side warp 3 adjacent to each other have a design of passing under lower side weft 7'*d*. Since protrusion of warp binding yarn 2A having a smaller diameter is smaller than that of lower side warp 3, warp binding yarn 2A of a smaller diameter does not easily wear away. A fabric has therefore excellent wear resistance by having a binding warp pair disposed between warp pairs.

It is preferred that on the lower side surface, two warps adjacent to each other weave a lower side weft from the lower side, whereby the lower side weft forms a weft long crimp corresponding to a plurality of warps on the lower side surface; and all the warps constituting the lower side surface each forms zigzag arrangement by approaching right-hand and left-hand warps adjacent thereto alternately at a portion where it weaves a lower side weft from the lower side.

The term "zigzag arrangement" means a structure in which a warp on the lower side forms a knuckle under a lower side weft under which a right-hand warp adjacent thereto on the lower side also forms a knuckle and then it forms a knuckle under a lower side weft under which a left-hand warp adjacent thereto on the lower side forms a knuckle, thus alternately approaching the right-hand warp and left-hand warp. By the zigzag arrangement, the resulting fabric has improved rigidity in the diagonal direction and has both an overlapped portion and non-overlapped portion of a warp on the upper side and a warp on the lower side. Since meshes with a random size or shape can be formed, stepwise dehydration can be carried out, making it possible to prevent generation of dehydration marks, sticking of a sheet raw material onto a wire or falling-off of a fiber or filler from the wire.

For example, the lower side warp 1*b*, simultaneously with warp binding yarn 2B which is adjacent thereto on the right hand side, forms a knuckle under lower side weft 1'*d* and then forms, simultaneously with the lower side warp 8 which is adjacent to the lower side warp 1*b* on the left hand side, another knuckle under lower side weft 8'*d*. This brings lower side warp 1*b* to the right side at the intersection with lower side weft 1'*d* and to the left side at the intersection with lower side weft 8'*d*. On the upper side surface, different from warps on the lower side, upper side warps and warp binding yarns on the upper side do not have a design constituting zigzag arrangement so that upper and lower warps overlap with each other in some portions and they do not overlap in some portions. The dehydration holes penetrating from the upper side to the lower side do not have a uniform shape, making it possible to prevent partially rapid dehydration. Only lower side warps 1 and 3 were so far described, but other lower side warps and warp binding yarns also adopt similar zigzag arrangement so that the resulting fabric as a whole can be equipped with similar characteristic.

Example 2

Figure 4:
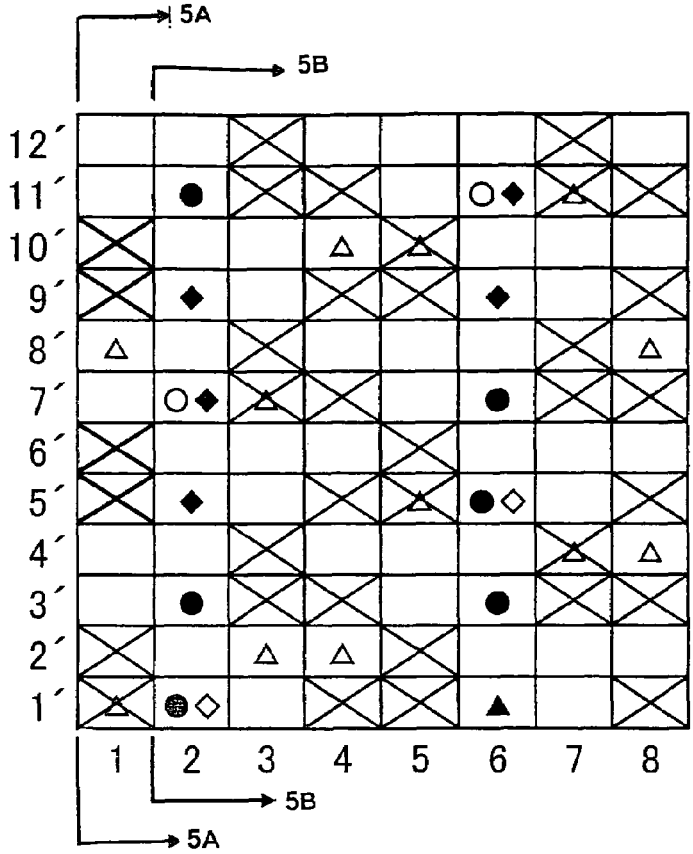
FIG. 4 is a design diagram showing a repeating unit of an industrial two-layer fabric of Example 2 according to the present invention.
Figure 5A:
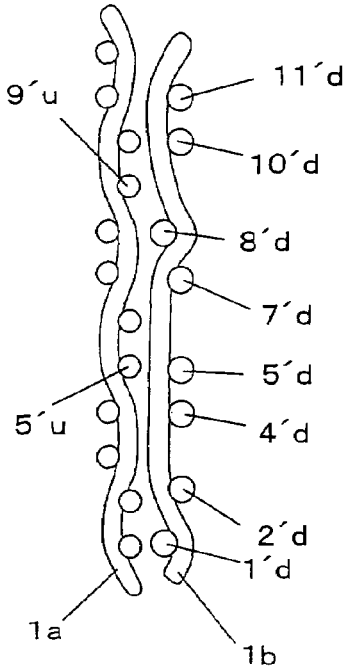
FIGS. 5A and 5B includes cross-sectional views taken along the lines 5A-5A and 5B-5B at warps of warp pair 1 and warp binding yarn pair 2 illustrated in FIG. 4 respectively.
Figure 5B:
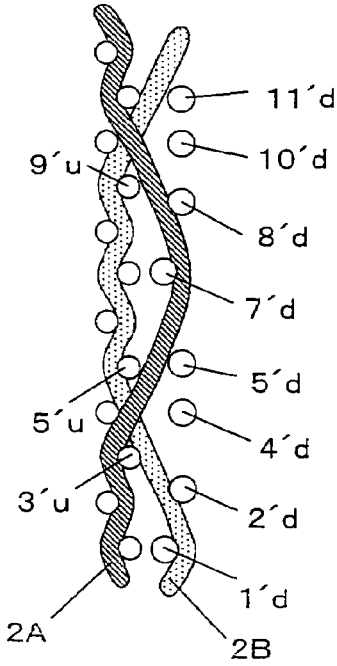

FIG. 4 is a design diagram showing a repeating unit of a fabric of Example 2 of the present invention. FIGS. 5A and 5B include cross-sectional views along lines 5A-5A and 5B-5B at warp pair 1 and binding warp pair 2 illustrated in the design diagram of FIG. 4. In Example 1, two warp designs form the upper side surface design. Warps 1, 3, 5, and 7 on the upper side each has a 1/1 design, while warps 2, 4, 6 and 8 on the upper side each has a 2/2 design. In this Example 2, on the contrary, warps 1, 3, 5 and 7 on the upper side has a 2/2 design, while warps 2, 4, 6 and 8 on the upper side each has a 1/1 design. In the present Example 2, therefore, the binding warp pairs have a 1/1 design on the upper side surface. The other conditions are similar to those in Example 1.

The fabric of the present Example has two warp designs different from each other on the lower side surface. Warps 1, 3, 4, 5, 7 and 8 on the lower side each has a 4/1-2/1 design in which it passes over four lower side wefts, under a lower side weft, over two lower side wefts and under a lower side weft. Warps 2 and 6 on the lower side each has a 3/1 design in which passing over three lower side wefts and under a lower side weft is repeated. Lower side wefts each has a design in which it passes over two warps on the lower side which are adjacent to each other and then passes under six successive warps on the lower side to form a weft long crimp on the lower side surface.

In this Example, warp binding yarns forming a pair have the same design. Referring to the cross-sectional view of warp binding yarn pair 2 in FIG. 5B, warp binding yarn 2A passes over upper side weft 1'*u*, under 2'*u* and over 3'*u*, heads to the lower side, passes under lower side weft 7'*d*, heads to the upper side, and passes over upper side weft 11'*u* and under 12'*u*. Warp binding yarn 2B has a design in which it passes under lower side weft 1'*d*, heads to the upper side, passes over upper side weft 5'*u*, under 6'*u*, over 7'*u*, under 8'*u* and over 9'*u*, and then heads to the lower side. They form three knuckles passing over an upper side weft and then pass under a lower side weft, thus forming the same design. By using them in combination, they form a 1/1 design on the upper side and a 3/1 design on the lower side surface. Warp binding yarns 2A and 2B both have a bilaterally symmetrical design relative to a lower side knuckle. Upper side wefts and lower side wefts are arranged at a ratio of 3:2 so that they are not completely bilaterally symmetrical. Because of a fabric design, lower side weft 7'*d* sometimes moves to the side of 8'*d* so that warp binding yarns 2A and 2B have a substantially symmetrical design. The dent depths at intersections of warp binding yarns forming a pair can be made uniform by adopting for them the same and bilaterally symmetrical design.

Example 3

Figure 6:
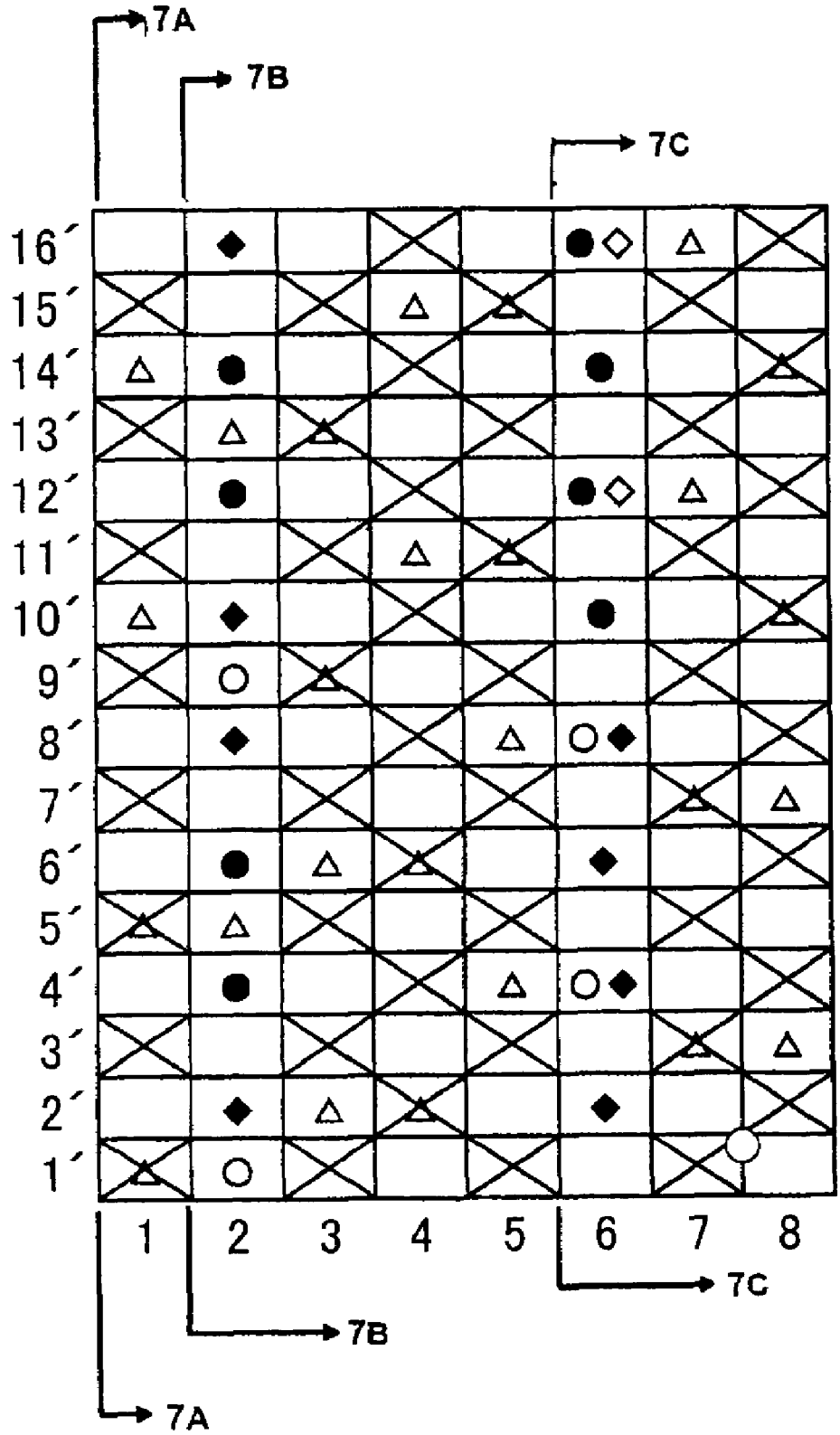
FIG. 6 is a design diagram showing a repeating unit of an industrial two-layer fabric of Example 3 according to the present invention.
Figure 7A:
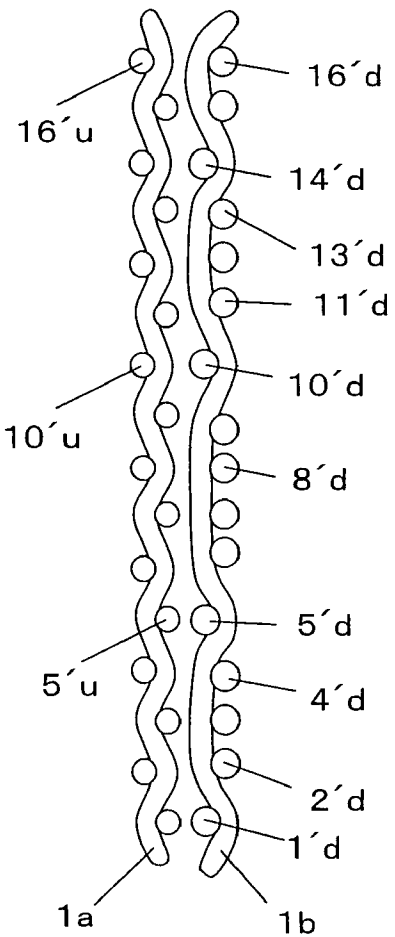
FIGS. 7A, 7B and 7C include cross-sectional views taken along the lines 7A-7A, 7B-7B and 7C-7C at warps of warp pair 1, warp binding yarn pair 2 and warp binding yarn pair 6 illustrated in FIG. 6 respectively.
Figure 7B:
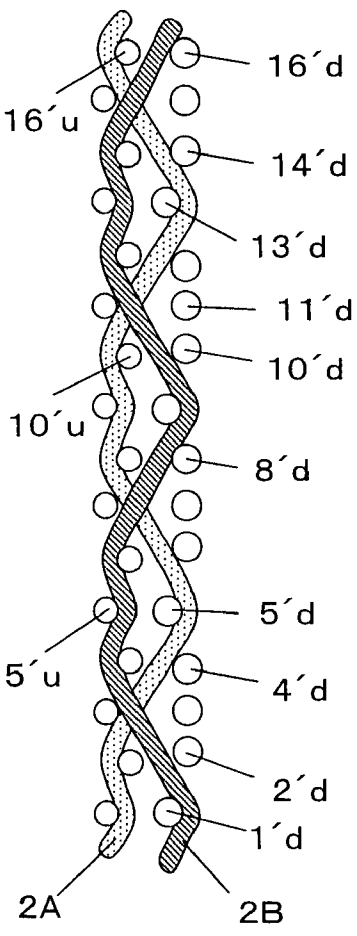
Figure 7C:
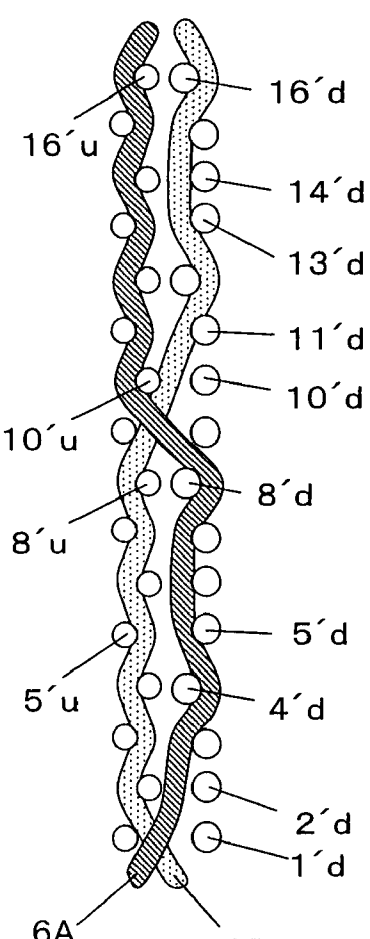

FIG. 6 is a design diagram showing a repeating unit of a fabric of Example 3 according to the present invention. FIGS. 7A, 7B and 7C include cross-sectional views of warp pair 1 and binding warp pairs 2 and 6 illustrated in the design diagram of FIG. 6 along the lines of 7A-7A, 7B-7B and 7C-7C. The fabric is a 16-shaft two-layer fabric having binding warp pairs at a ratio of 2/8. It has two different warp designs for the lower side surface design, and upper side wefts and lower side wefts are arranged at a ratio of 1:1.

In the design diagram of FIG. 6, indicated at numerals 2 and 6 are binding warp pairs each composed of two warp binding yarns, while indicated at numerals 1, 3, 4, 5, 7 and 8 are warp pairs each composed of an upper side warp and a lower side warp. The binding warp pairs for weaving upper and lower layers are arranged at a ratio of 2/8.

The fabric of the present Example has two different warp designs as the lower side surface design, that is, a 3/1-4/1-3/1-2/1 design in which each of warps 1, 3, 4, 5, 7 and 8 on the lower side passes over three lower side wefts, under a lower side weft, over four lower side wefts, under a lower side weft, over three lower side wefts, under a lower side weft, over two lower side wefts and under a lower side weft, and repetition of a design in which warps 2 and 6 on the lower side each passes over three lower side wefts and under a lower side weft. A lower side weft passes over two warps on the lower side, which are adjacent to each other, and then passes under six successive warps on the lower side to form a weft long crimp on the lower side surface. The upper side surface design is a 1/1 design in which passing over an upper side weft and then under a lower side weft is repeated.

In this Example, warps 2 and 6 form a binding warp pair but they have different designs, which can be understood from the cross-sectional views of warp binding yarns 2 and 6 in FIGS. 7B and 7C respectively. Warp binding yarn 2A has a design in which it passes under upper side weft 1'*u* and over 2'*u*, heads to the lower side, passes under lower side weft 5'*d*, heads to the upper side, passes over upper side weft 8'*u*, under 9'*u* and over 10'*u*, heads to the lower side, passes under lower side weft 13'*d*, heads to the upper side, and passes over upper side weft 16'*u*. Warp binding yarn 2B has a design in which it passes under lower side weft 1'*d*, heads to the upper side, passes over, 4'*u*, under 5'*u* and over 6'*u*, heads to the lower side, passes under lower side weft 9'*d*, heads to the upper side, passes over upper side weft 12'*u*, under 13'*u* and over 14'*u*, and heads to the lower side. This suggests that warp binding yarns 2A and 2B have the same design. Warp binding yarns 2A and 2B cooperatively form a 1/1 design on the upper side surface and a 3/1 design on the lower side surface.

Warp binding yarn 6A has a design in which it passes under lower side weft 4'*d*, passes between upper side wefts 5'*u*, 6'*u* and 7'*u* and lower side wefts 5'*d*, 6'*d* and 7'*d*, passes under lower side weft 8'*d*, heads to the upper side, and passes over upper side weft 10'*u*, under 11'*u*, over 12'*u*, under 13'*u*, over 14'*u*, under 15'*u* and over 16'*u*, while warp binding yarn 6B has a design in which it passes under upper side weft 1'*u*, over 2'*u*, under 3'*u*, over 4'*u*, under 5'*u*, over 6'*u*, under 7'*u* and over 8'*u*, heads to the lower side, passes under lower side weft 12'*d*, passes between upper side wefts 13'*u*, 14'*u* and 15'*u* and lower side wefts 13'*d*, 14'*d* and 15'*d*, and then passes under lower side weft 16'*d*. This suggests that warp binding yarns 6A and 6B have the same design. Warp binding yarns 6A and 6B cooperatively form a 1/1 design on the upper side surface and a 3/1 design on the lower side surface.

In this Example, two pairs of warp binding yarns have respective designs different from each other, but a 1/1 design is formed on the upper side surface and a 3/1 design is formed on the lower side surface. Warp binding yarns 2A, 2B, 6A and 6B each has a bilaterally symmetrical design relative to a lower side knuckle. Dent depths at the intersection of warp binding yarns forming a pair can be made uniform by adopting a bilaterally symmetrical design.

Example 4

Figure 8:
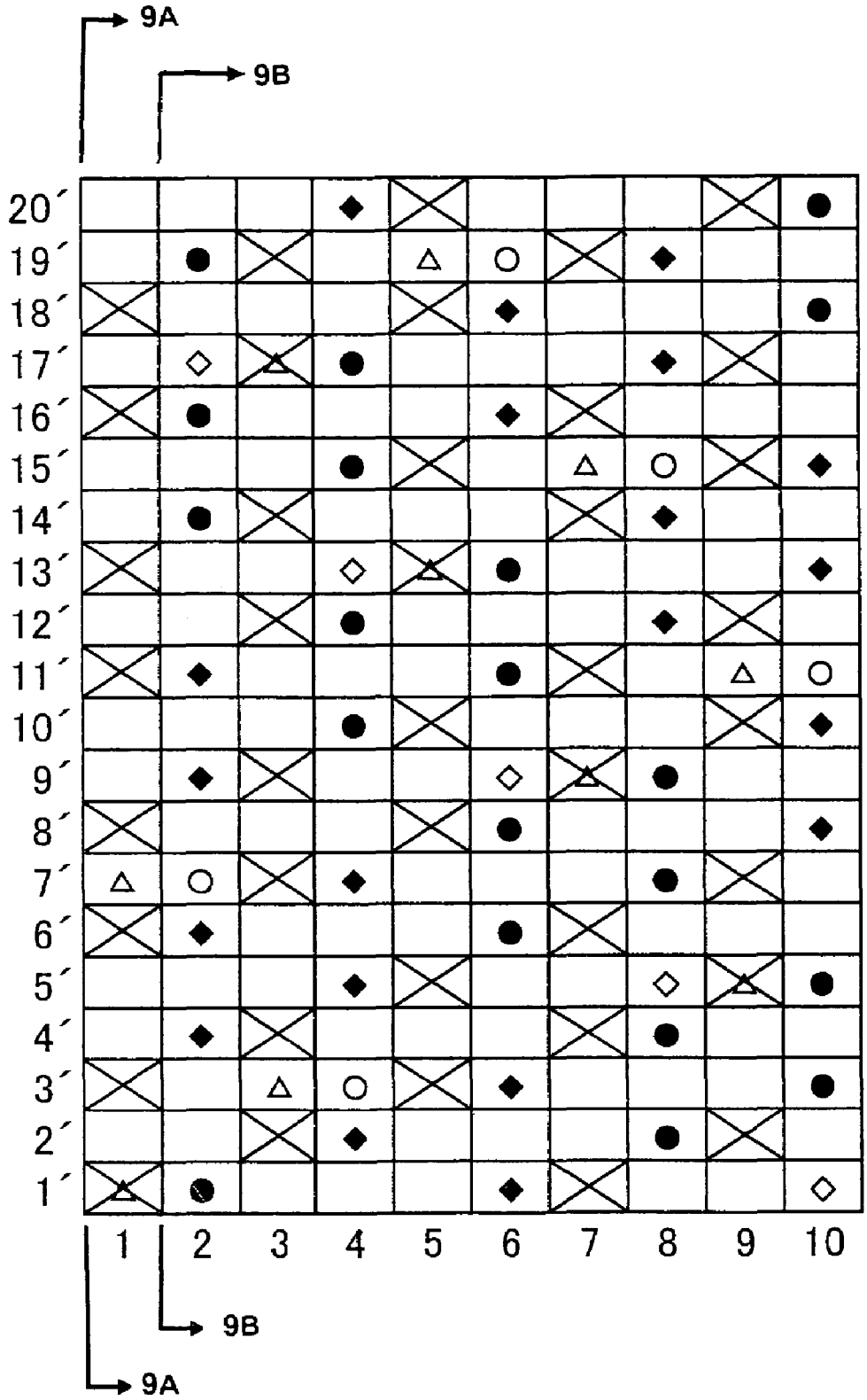
FIG. 8 is a design diagram showing a repeating unit of an industrial two-layer fabric of Example 4 according to the present invention.
Figure 9A:
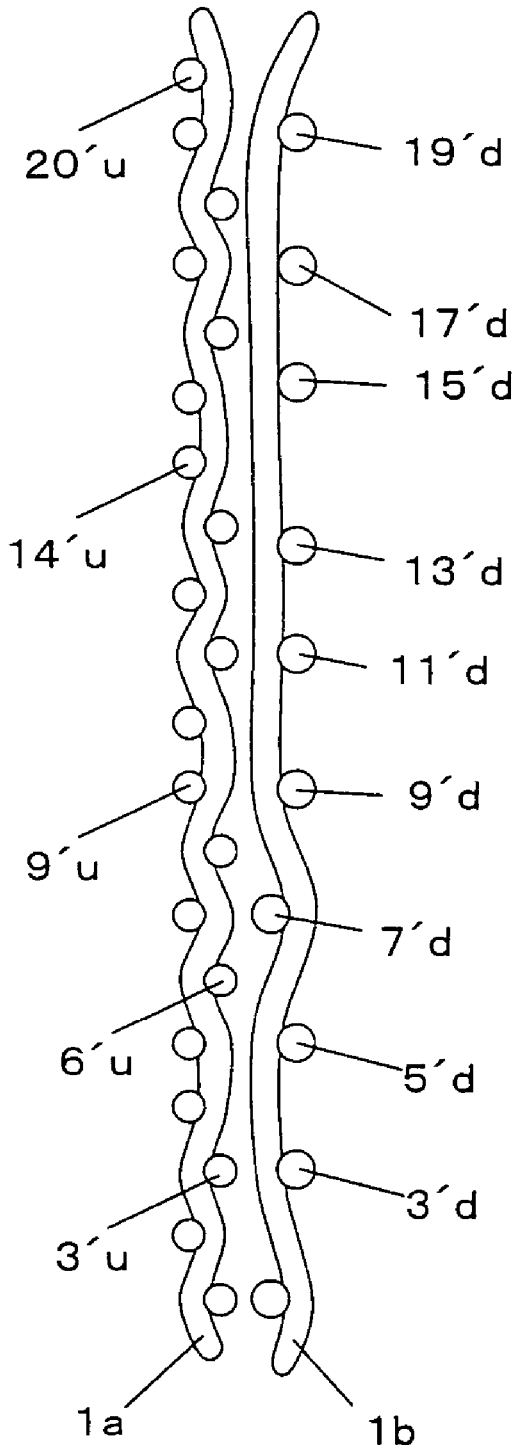
FIGS. 9A and 9B include cross-sectional views taken along the lines 9A-9A and 9B-9B at warps of warp pair 1 and warp binding yarn pair 2 illustrated in FIG. 8 respectively.
Figure 9B:
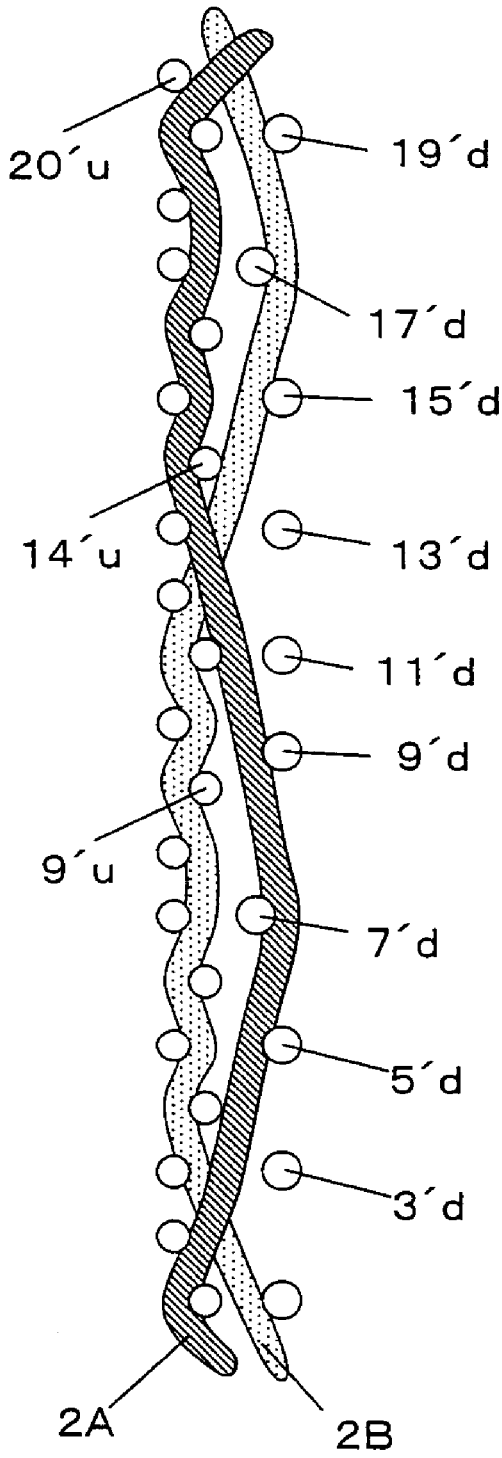

FIG. 8 is a design diagram showing a repeating unit of a fabric of Example 4 according to the present invention. FIGS. 9A and 9B include the cross-sectional views of warp pair 1 and warp binding yarn pair 2 illustrated in the design diagram of FIG. 8 along the lines 9A-9A respectively. This fabric is a 20-shaft two-layer fabric with the binding warp pair disposed at a ratio of 5/10. This fabric has, on the lower side surface, two different warp designs. Upper side wefts and lower side wefts are arranged at a ratio of 2:1.

In the diagram of FIG. 8, indicated at numerals 1, 3, 5, 7 and 9 are warp pairs composed of an upper side warp and a lower side warp, while indicated at numerals 2, 4, 6, 8 and 10 are binding warp pairs having two warp binding yarns.

This fabric has, on the lower side surface, two different warp designs, that is, a 2/1-6/1 design in which warps 1, 3, 5, 7 and 9 on the lower side each passes over two lower side wefts, under a lower side weft, over six lower side wefts and a lower side weft and a 4/1 design in which warps 2, 4, 6, 8 and 10 on the lower side each passes over four lower side wefts and passes under a lower side weft. Lower side wefts each has a design in which it passes over two warps on the lower side which are adjacent to each other, and then passes under eight successive warps on the lower side to form a weft long crimp on the lower side surface.

This fabric has, on the upper side surface, a 1/1-1/2 design in which passing over an upper side weft, under an upper side weft, over an upper side weft and under two upper side wefts is repeated.

In this Example, two warp binding yarns having the same design form a pair. Use of these two warp binding yarns in combination makes it possible to form a 1/1-1/2 design on the upper side surface and a 4/1 design on the lower side surface. Warp binding yarns 2A and 2B each has a bilaterally symmetrical design relative to a lower side knuckle and in addition, these two yarns have the same design. Dent depths at the intersections of warp binding yarns and knuckle heights can be made uniform by employing the same and bilaterally symmetrical design for warp binding yarns forming a pair.

Example 5

Figure 10:
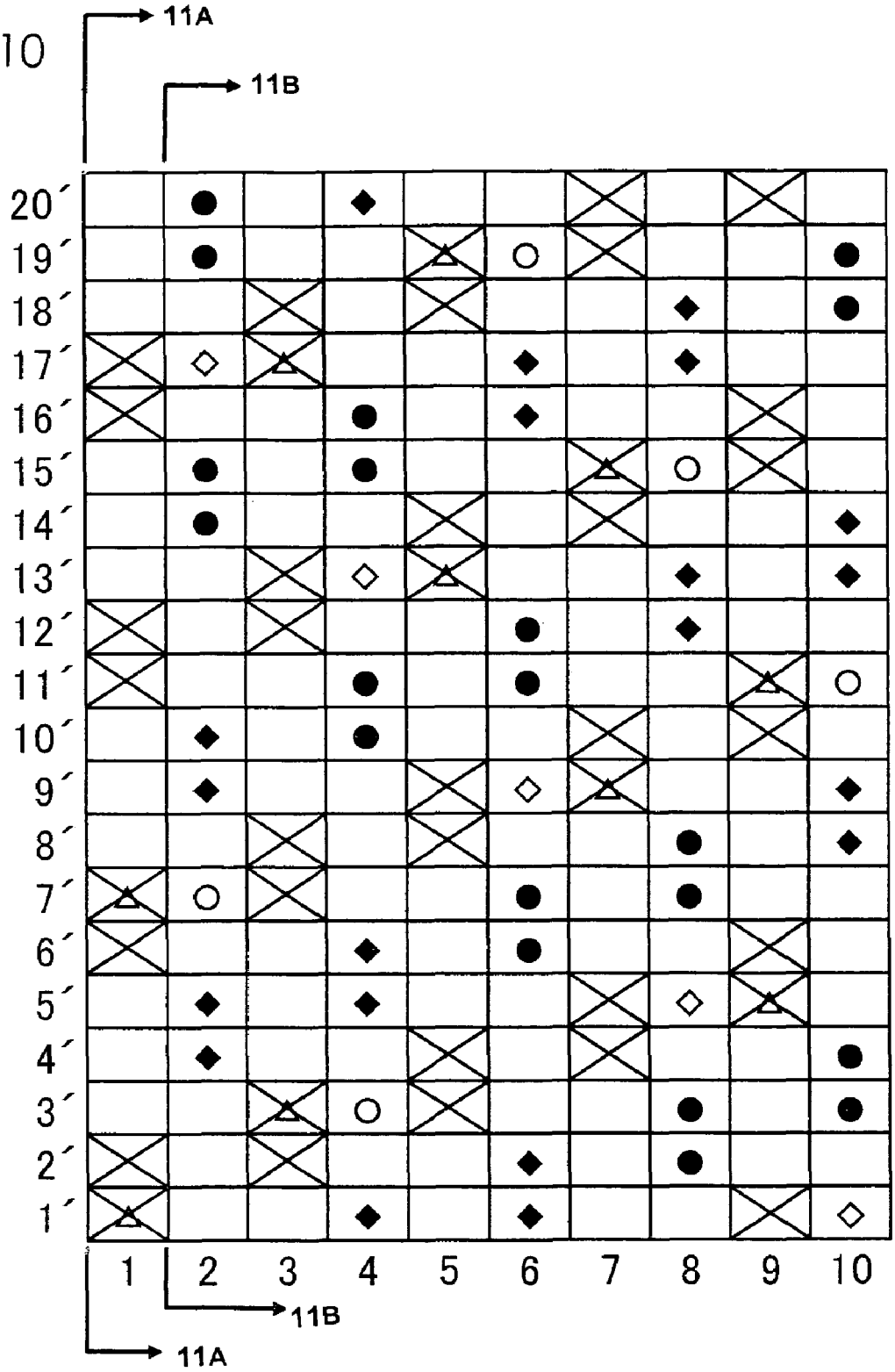
FIG. 10 is a design diagram showing a repeating unit of an industrial two-layer fabric of Example 5 according to the present invention.
Figure 11A:
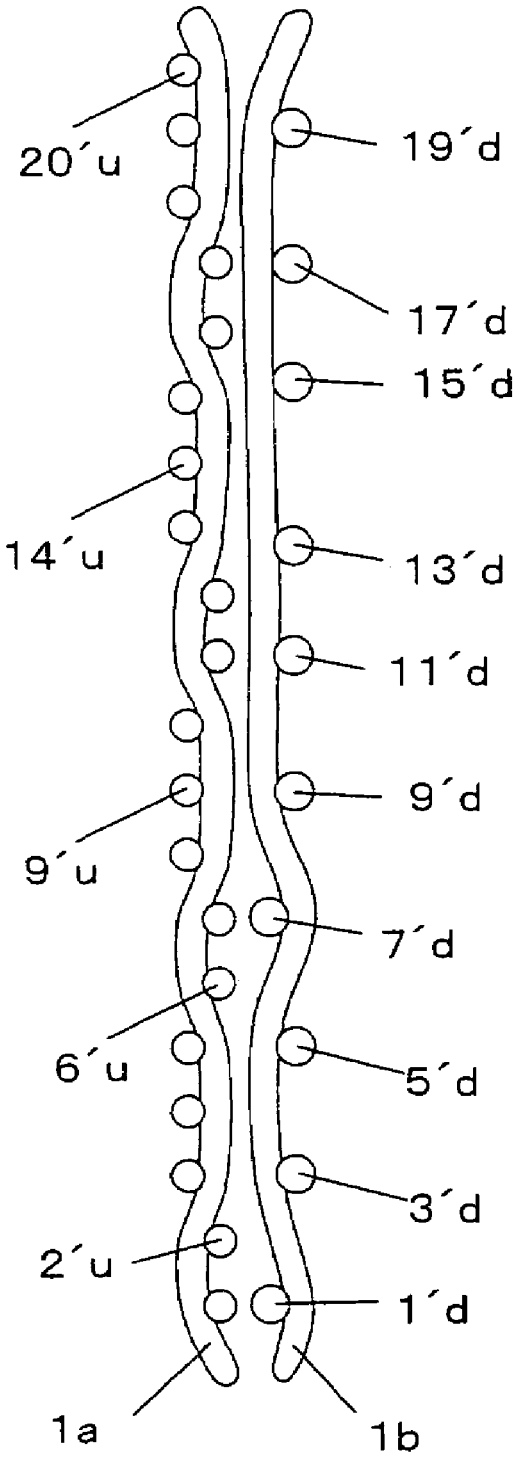
FIGS. 11A and 11B include cross-sectional views taken along the lines 11A-11A and 11B-11B at warps of warp pair 1 and warp binding yarn pair 2 illustrated in FIG. 10 respectively.
Figure 11B:
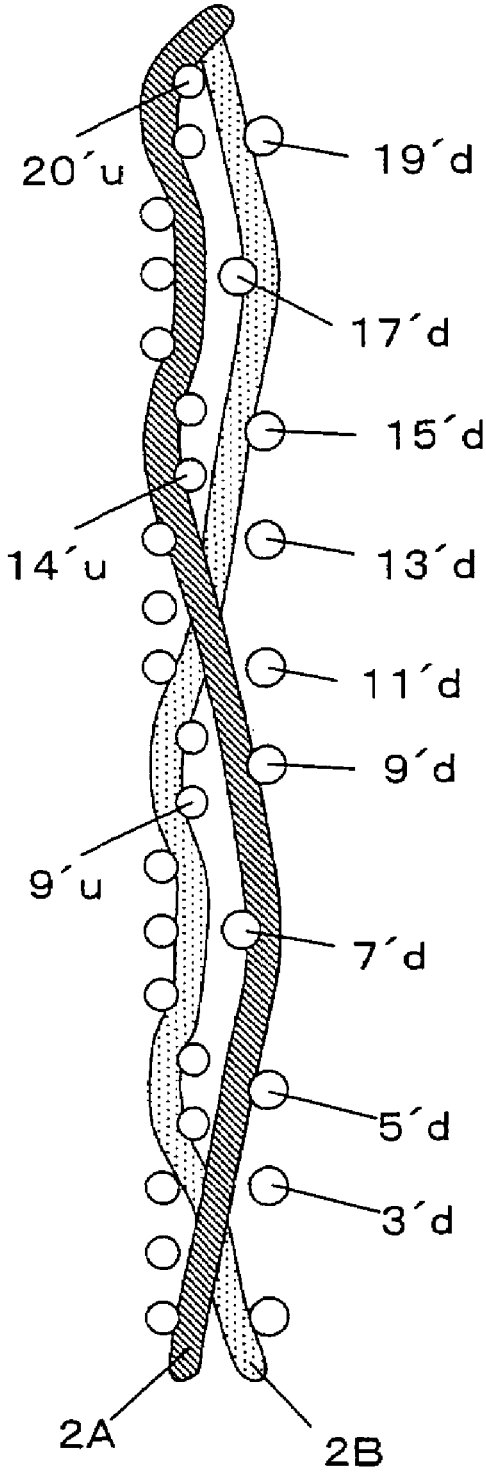

FIG. 10 is a design diagram showing a repeating unit of the fabric of Example 5 according to the present invention. FIGS. 11A and 11B include cross-sectional views illustrating warp pair 1 and binding warp pair 2 illustrated in the design diagram 10 respectively.

This fabric has two different warp designs on the lower side surface. Warps 1, 3, 5, 7 and 9 on the lower side each has a 2/1-6/1 design in which it passes over two lower side wefts, under a lower side weft, over six lower side wefts and a lower side weft, while warps 2, 4, 6, 8 and 10 on the lower side has a 4/1 design in which passing over four lower side wefts and under a lower side weft is repeated. Lower side wefts each has a design in which it passes over two warps on the lower side which are adjacent to each other, and then passes under eight successive warps on the lower side to form a weft long crimp on the lower side surface.

The fabric has, on the upper side surface, has a 2/3 design in which passing over two upper side wefts and under three upper side wefts is repeated.

In this Example, two warp binding yarns forming a pair have the same design. Use of these two warp binding yarns in combination makes it possible to form a 2/3 design on the upper side surface and a 4/1 design on the lower side surface. Warp binding yarns 2A and 2B have a bilaterally symmetrical design relative to a lower side knuckle and these two yarns have the same design. Dent depths at the intersections of warp binding yarns can be made uniform by employing warp binding yarns having a bilaterally symmetrical design. As in this Example, employment of a bilaterally symmetrical design relative to a lower side knuckle makes it possible to form a fabric excellent in uniformity as a whole because knuckles of warp binding yarns have the same height and dent depths at the intersection of warp binding yarns 2A and 2B are uniform.

Example 6

Figure 12:
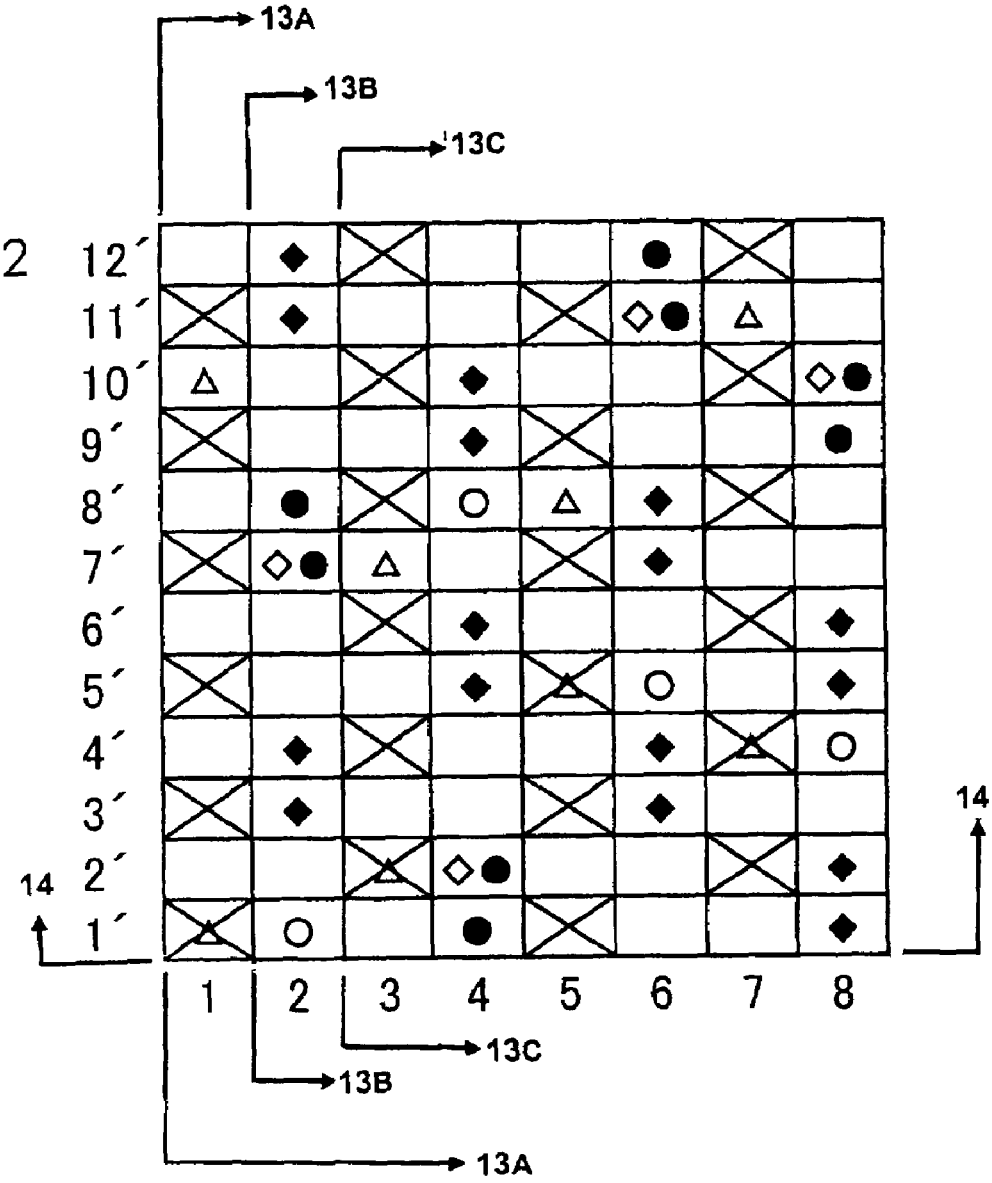
FIG. 12 is a design diagram showing a repeating unit of an industrial two-layer fabric of Example 6 according to the present invention.
Figure 13A:
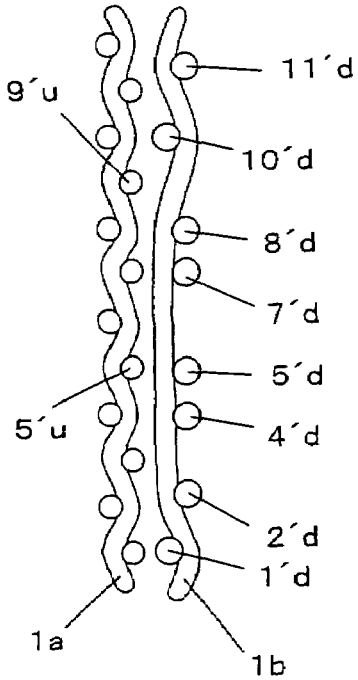
FIGS. 13A, 13B and 13C include cross-sectional views taken along the lines 13A-13A, 13B-13B and 13C-13C at warps of warp pair 1, warp binding yarn pair 2 and warp pair 3 illustrated in FIG. 12 respectively.
Figure 13B:
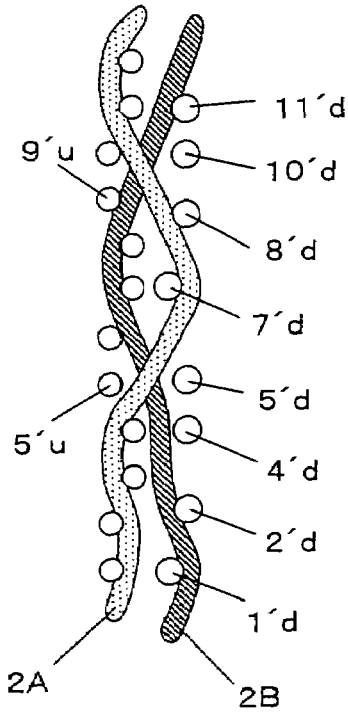
Figure 13C:
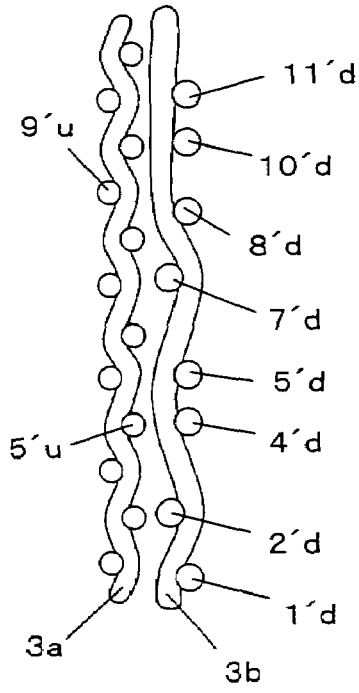
Figure 14:
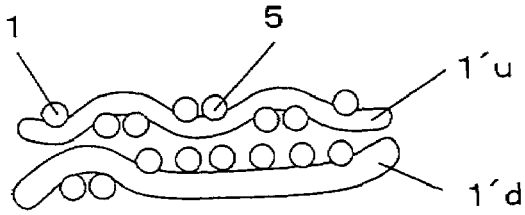
FIG. 14 is a cross-sectional view taken along the line 14-14 at vertically stacked wefts of weft pair 1 illustrated in FIG. 12.

FIG. 12 is a design diagram showing a repeating unit of a fabric of Example 6 according to the present invention. FIGS. 13A, 13B and 13C include cross-sectional views of warp pair 1, binding warp pair 2 and warp pair 3 illustrated in the diagram of FIG. 12 along the lines 13A-13A, 13B-13B and 13C-13C respectively. FIG. 14 is a cross-sectional view taken along weft 1' illustrated in the diagram of FIG. 12 along the line 14-14 and having an upper side weft and a lower side weft stacked vertically. This fabric is a 16-shaft two-layer fabric having binding warp pairs disposed at a ratio of 4/8. It has three different warp designs on the lower side surface, while it has two different warp designs on the upper side surface. Upper side wefts and lower side wefts are arranged at a ratio of 3:2.

The fabrics of Examples 1 to 5 have two warp designs on the lower side, but the fabric in this Example has three warp designs on the lower side. What this fabric has in common with the above-described examples is that a warp binding yarn can be made bilaterally symmetrically relative to a lower side knuckle. Dent depths appearing at the intersections of warp binding yarns forming a pair are made uniform so that the resulting fabric has, as a whole, an excellent surface uniformity. The above-described examples and the present example are different in the number of warp designs, but no difference exists in their basic concepts. The present example is also one example embraced in the scope of right.

In the design diagram of FIG. 12, indicated at numerals 2, 4, 6 and 8 are binding warp pairs composed of two warp binding yarns, while indicated at numerals 1, 3, 5 and 7 are warp pairs composed of an upper side warp and a lower side warp.

This fabric has three different warp designs on the lower side surface. Warps 1 and 5 on the lower side each has a 5/1-1/1 design in which it passes over five lower side wefts, under a lower side weft, over a lower side weft and under a lower side weft; warps 2, 4, 6 and 8 on the lower side each has a 3/1 design in which passing over three lower side wefts and under a lower side weft is repeated; and warps 3 and 7 on the lower side each has a 4/1-2/1 design in which it passes over four lower side wefts, under a lower side weft, over two lower side wefts and under a lower side weft. Warps 2, 4, 6 and 8 are pairs of binding warps. By using two binding warps as a pair, they function as one lower side warp similar to other lower side warps and form the above-described design.

Lower side wefts each has a design in which it passes over two warps on the lower side which are adjacent to each other and then under six successive warps on the lower side to form a weft long crimp on the lower side. By employing a design in which a weft long crimp is formed on the lower side surface, the resulting fabric has excellent wear resistance. In addition, a lower side weft is woven from the lower side by two warps adjacent to each other so that the resulting fabric has improved rigidity. Simultaneously, a long crimp protrudes from the lower side surface and increases a wear resistant volume so that the resulting fabric has excellent wear resistance.

Two warp designs different from each other are alternately disposed on the upper side surface. Warps 1, 3, 5 and 7 on the upper side each forms a 1/1 design in which passing over an upper side weft and under an upper side weft is repeated. Warps 2, 4, 6 and 8 on the upper side each forms a 2/2 design in which passing over two upper side wefts and under two upper side wefts is repeated. As in the lower side surface design, warps 2, 4, 6 and 8 are binding warp pairs. By using two binding warps as a pair, they function and form the above-described design as an upper side warp similar to other upper side warps.

In this Example, warp binding yarns forming a pair have respective designs different from each other. Referring to the cross-sectional view of warp binding yarn pair 2 in FIG. 13, warp binding yarn 2A has a design in which it passes under upper side wefts 1'*u* and 2'*u*, passes over upper side wefts 3'*u* and 4'*u*, heads to the lower side, passes under lower side weft 7'*d*, heads to the upper side and passes over upper side wefts 11'*u* and 12'*u*, while warp binding yarn 2B has a design in which it passes under lower side weft 1'*d*, heads to the upper side, passes over upper side wefts 7'*u* and 8'*u* and heads to the lower side. Although their designs are different, by using them in combination, a 2/2 design is formed on the upper side surface, while a 3/1 design is formed on the lower side surface. Warp binding yarns 2A and 2B both have a bilaterally symmetrical design relative to a lower side knuckle. Upper side wefts and lower side wefts are arranged at a ratio of 3:2 so that their design is not completely symmetrical. Lower side weft 7'*d* sometimes moves to the side of 8'*d* because of a fabric design so it is substantially symmetrical. Employment of a bilaterally symmetrical design for warp binding yarns forming a pair makes it possible to make uniform the height of knuckles on the upper side surface and dent depths at the intersections of these warp binding yarns.

Example 7

Figure 15:
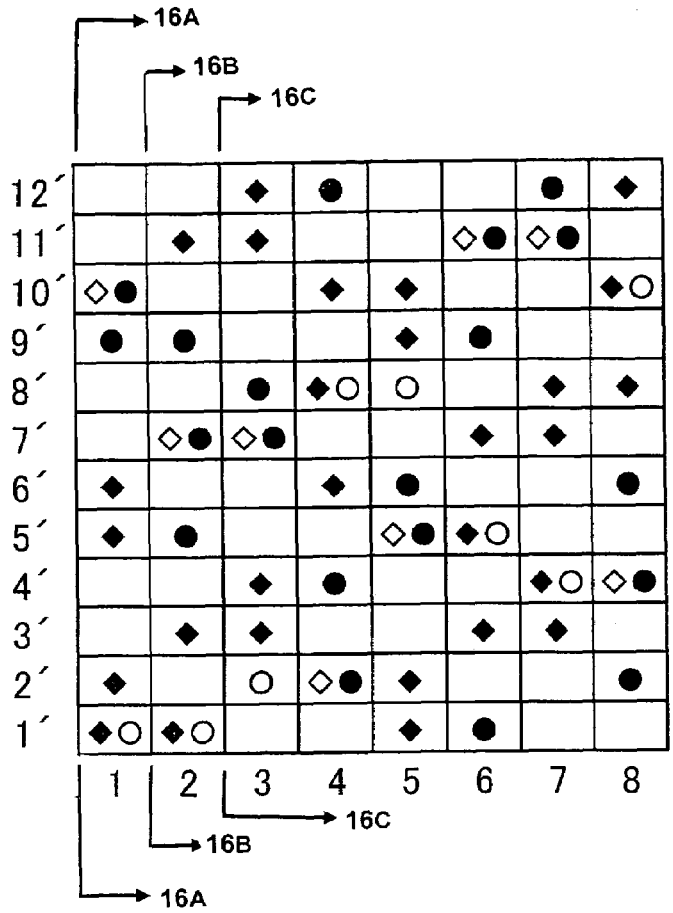
FIG. 15 is a design diagram showing a repeating unit of an industrial two-layer fabric of Example 7 according to the present invention.
Figure 16A:
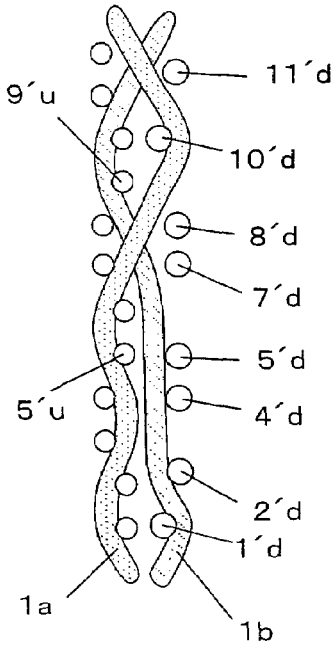
FIGS. 16A, 16B and 16C include cross-sectional views taken along the lines 16A-16A, 16B-16B and 16C-16C at warps of warp binding yarn pair 1, warp binding yarn pair 2 and warp binding yarn pair 3 illustrated in FIG. 15 respectively.
Figure 16B:
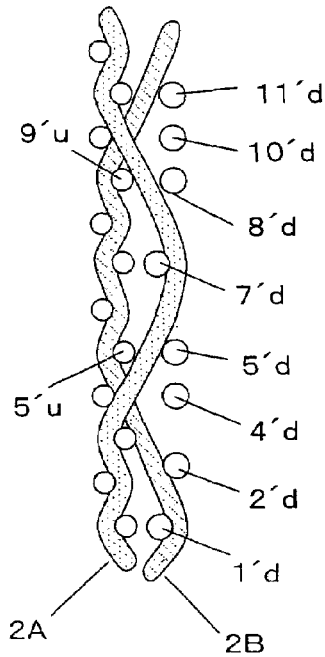
Figure 16C:
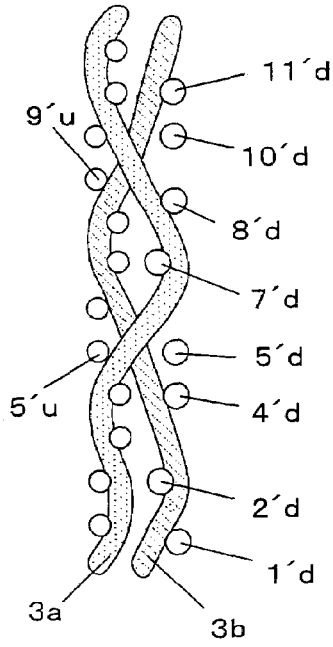

FIG. 15 is a design diagram showing a repeating unit of a fabric of Example 7 according to the present invention. FIGS. 16A, 16B and 16C include the cross-sectional views of binding warp pairs 1, 2 and 3 illustrated in the design diagram of FIG. 15 along the lines 16A-16A, 16B-16B and 16C-16C respectively. The fabric has two warp designs on the upper side surface. A 1/1 design and a 2/2 design are alternately disposed for the warps on the upper side. The fabric in this Example has excellent binding strength because all the warp pairs are binding warp pairs.

The fabric of this Example has three different warp designs on the lower side surface. Warps 1 and 5 on the lower side each has a 5/1-1/1 design in which it passes over five lower side wefts, passes under a lower side weft, passes over a lower side weft and passes under a lower side weft. Warps 2, 4, 6 and 8 on the lower side each has a 3/1 design in which passing over three lower side wefts and under a lower side weft is repeated. Warps 3 and 7 on the lower side has a 4/1-2/1 design in which it passes over four lower side wefts, under a lower side weft, over two lower side wefts and under a lower side weft. Warps 1 to 8 are pairs of binding warps. By using two binding warps as a pair, they function and form the above-described design as one lower side warp similar to other lower side warps. As in this Example, a lower side warp to be woven with only a lower side weft and an upper side warp to be woven with only an upper side weft are not essential.

Lower side wefts each has a design in which it passes over two warps on the lower side, which are adjacent to each other, and then passes under six successive warps on the lower side to form a weft long crimp on the lower side.

Example 8

Figure 17:
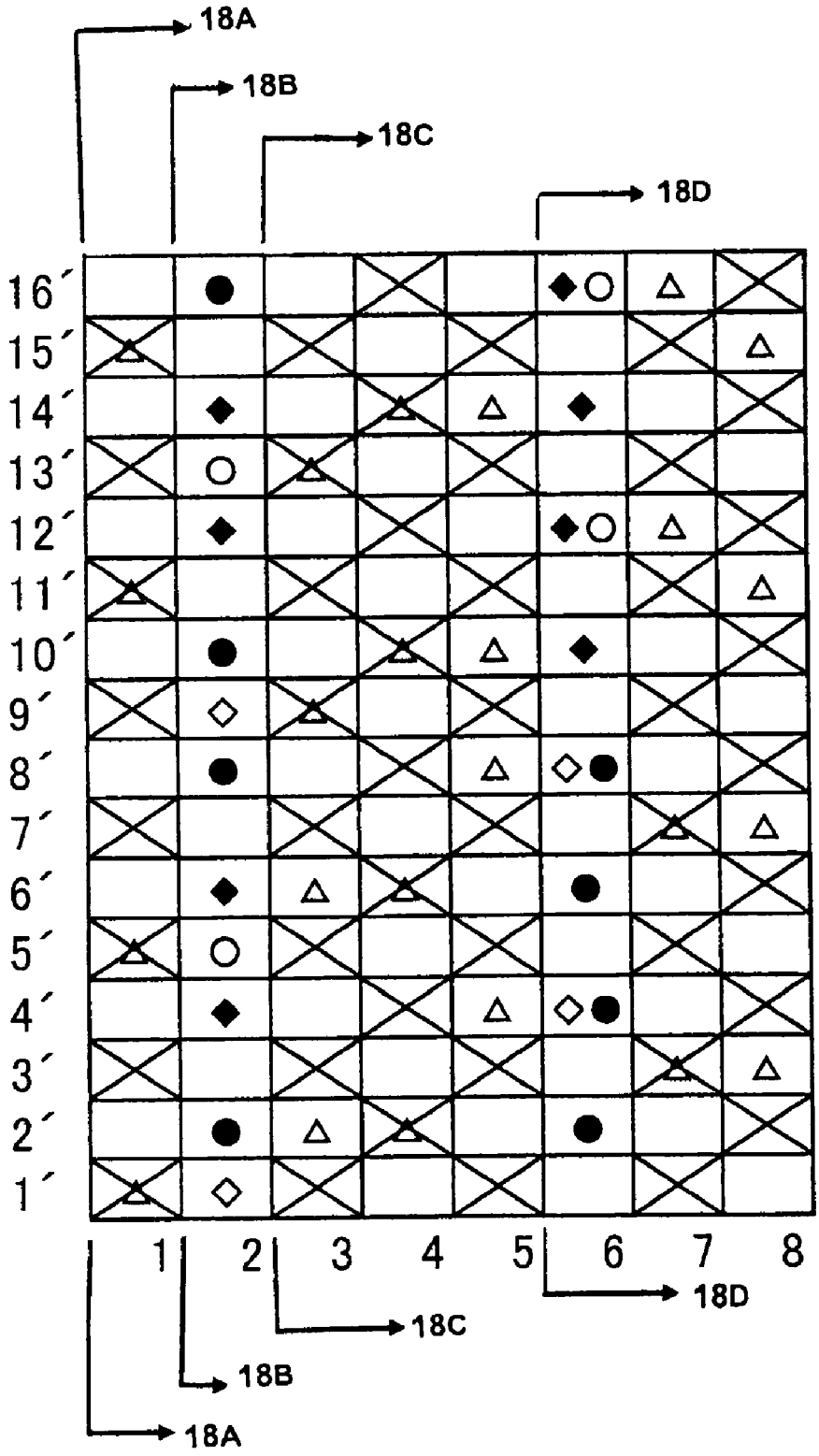
FIG. 17 is a design diagram showing a repeating unit of an industrial two-layer fabric of Example 8 according to the present invention.
Figure 18A:
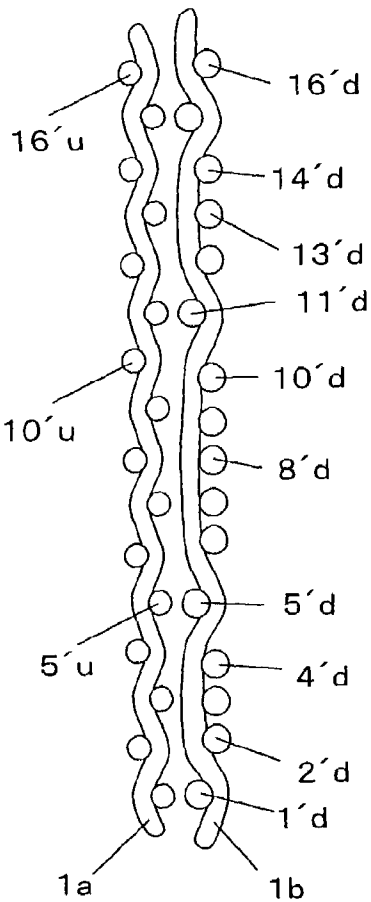
FIGS. 18A, 18B, 18C and 18D includes cross-sectional views taken along the lines 18A-18A, 18B-18B, 18C-18C and 18D-8D at warps of warp pair 1, warp binding yarn pair 2, warp pair 3 and warp binding yarn pair 6 illustrated in FIG. 17 respectively.
Figure 18B:
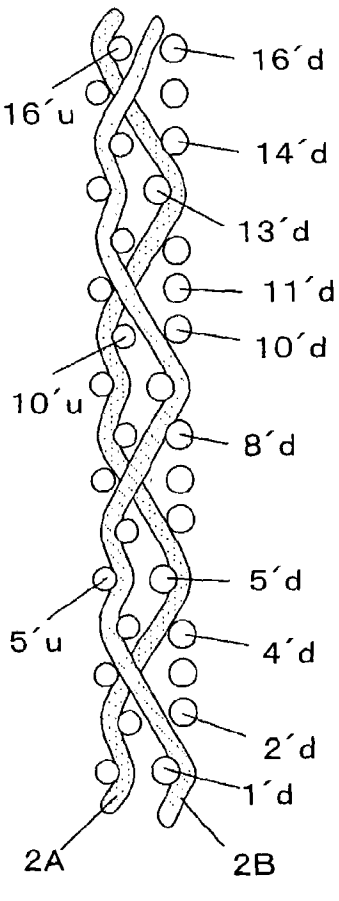
Figure 18C:
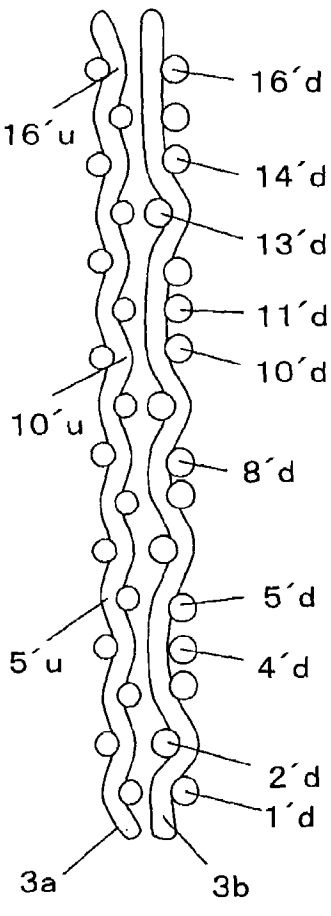
Figure 18D:
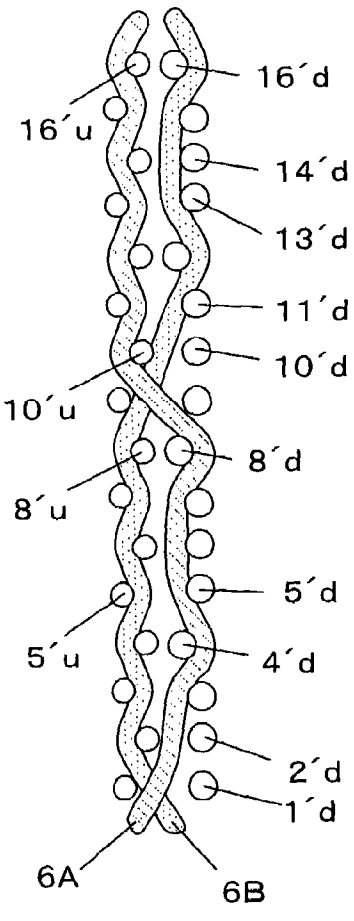

FIG. 17 is a design diagram of a fabric of Example 8 according to the present invention. FIGS. 18A, 18B, 18C and 18D include cross-sectional views of warp pairs 1 and 3 and binding warp pairs 2 and 6 illustrated in the design diagram of FIG. 17 along the lines 18A-18A, 18B-18B, 18C-18C and 18D-18D respectively. The fabric is a 16-shaft two-layer fabric having the binding warp pairs disposed at a ratio of 2/8. It has three different warp designs on the lower side surface. Upper side wefts and lower side wefts are arranged at a ratio of 1:1.

In the design diagram of FIG. 17, indicated at numerals 2 and 6 are binding warp pairs composed of two warp binding yarns, while indicated at numerals 1, 3, 4, 5, 7 and 8 are warp pairs composed of an upper side warp and a lower side warp. The binding warp pairs for weaving upper and lower layers are arranged at a ratio of 2/8.

The fabric has three different warp designs on the lower side surface. Warps 1 and 5 on the lower side each has a 3/1-5/1-3/1-1/1 design in which it passes over three lower side wefts, under a lower side weft, over five lower side wefts, under a lower side weft, over three lower side wefts, under a lower side weft, over a lower side weft, and under lower side weft; warps 2, 4, 6 and 8 on the lower side each has a 3/1 design in which passing over three lower side wefts and under a lower side weft is repeated; and warps 3 and 7 on the lower side each a 3/1-2/1-3/1-4/1 design in which it passes over three lower side wefts, under a lower side weft, over two lower side wefts, under a lower side weft, over three lower side wefts, under a lower side weft, over four lower side wefts, and under a lower side weft. Lower side wefts each has a design in which it passes over two warps on the lower side which are adjacent to each other and then under six successive warps on the lower side to form a weft long crimp on the lower side.

The fabric has, on the upper side surface, a 1/1 design in which passing over an upper side weft and under an upper side weft is repeated. Warp 2 is a binding warp pair, but similar to other upper side warps, it functions and forms a design as an upper side warp.

In this Example, warp 2 and 6 are pairs of binding warps. Warps 2 and 6 are designs which are different from each other, which can be understood from the cross-sectional views of warp binding yarns 2 and 6 in FIG. 18. Warp binding yarn 2A has a design in which it passes under upper side weft 1'*u*, passes over 2'*u*, heads to the lower side, passes under lower side weft 5'*d*, heads to the upper side, passes over upper side weft 8'*u*, passes under 9'*u*, passes over 10'*u*, heads to the lower side, passes under lower side weft 13'*d*, heads to the upper side, and passes over upper side weft 16'*u*, while warp binding yarn 2B has a design in which it passes under lower side weft 1'*d*, heads to the upper side, passes over 4'*u*, passes under 5'*u*, passes over 6'*u*, heads to the lower side, passes under lower side weft 9'*d*, heads to the upper side, passes over upper side weft 12'*u*, passes under 13'*u*, passes over 14'*u* and heads to the lower side. This suggests that warp binding yarns 2A and 2B have the same design. Warp binding yarns 2A and 2B cooperatively form a 1/1 design on the upper side surface and a 3/1 design on the lower side surface.

Warp binding yarn 6A has a design in which it passes under lower side weft 4'*d*, passes between upper side wefts 5'*u*, 6'*u* and 7'*u* and lower side wefts 5'*d*, 6'*d* and 7'*d*, passes under lower side weft 8'*d*, heads to the upper side, passes over upper side weft 10'*u*, passes under 11'*u*, passes over 12'*u*, passes under 13'*u*, passes over 14'*u*, passes under 15'*u*, and passes over 16'*u*, while warp binding yarn 6B has a design in which it passes under upper side weft 1'*u*, passes over 2'*u*, passes under 3'*u*, passes over 4'*u*, passes under 5'*u*, passes over 6'*u*, passes under 7'*u*, passes over 8'*u*, heads to the lower side, passes under lower side weft 12'*d*, passes between upper side wefts 13'*u*, 14'*u* and 15'*u* and lower side wefts 13'*d*, 14'*d* and 15'*d* and then passes under lower side weft 16'*d*. This suggests that warp binding yarns 6A and 6B have the same design. Warp binding yarns 6A and 6B cooperatively form a 1/1 design on the upper side surface and a 3/1 design on the lower side surface.

In this Example, warp binding yarns forming a pair have the same design or mirror image design. By using two yarns in combination, the 1/1 design and 3/1 design are formed on the upper side surface and lower side surface, respectively. Warp binding yarns 2A and 2B each forms a bilaterally symmetrical design relative to a lower side knuckle. Warp binding yarns 6A and 6B form a mirror image design obtained by reversing the direction of the design. The heights of the intersection between these warp binding yarns are equal. By employing a bilaterally symmetrical design or mirror image design for warp binding yarns forming a pair, dent depths at the intersections of warp binding yarns forming a pair can be made uniform.

Example 9

Figure 19:
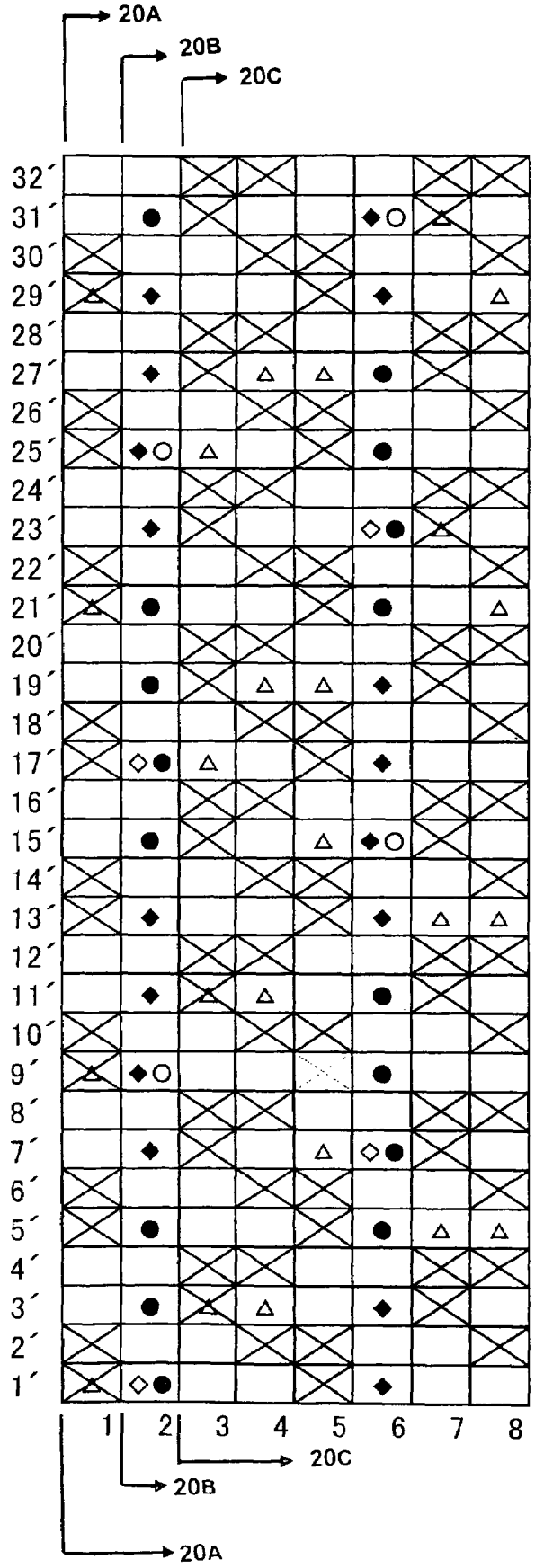
FIG. 19 is a design diagram showing a repeating unit of an industrial two-layer fabric of Example 9 according to the present invention.

FIG. 19 is a design diagram showing a repeating unit of a fabric of Example 9 according to the present invention. FIGS. 20A, 20B, and 20C include cross-sectional views of warp pair 1, binding warp pair 2 and warp pair 3 illustrated in the design diagram of FIG. 19 along the lines 20A-20A, 20B-20B, and 20C-20C. The fabric has two warp designs for forming the upper side surface design. Warps 1, 3, 5 and 7 on the upper side has a 2/2 design, while warps 2, 4, 6 and 8 on the upper side has a 1/1 design. Binding warp pairs form a 1/1 design on the upper side. Upper side wefts and lower side wefts are arranged at a ratio of 2:1.

The fabric has three different warp designs on the lower side surface. Warps 1 and 5 on the lower side each has a 3/1-5/1-3/1-1/1 design in which it passes over three lower side wefts, under a lower side weft, over five lower side wefts, under a lower side weft, over three lower side wefts, under a lower side weft, over a lower side weft and under a lower side weft; warps 2, 4, 6 and 8 on the lower side each has a 3/1 design in which passing over three lower side wefts and under a lower side weft is repeated; and warps 3 and 7 each has 3/1-2/1-3/1-4/1 design in which it passes over three lower side wefts, under a lower side weft, over two lower side wefts, under a lower side weft, over three lower side wefts, under a lower side weft, over four lower side wefts and under a lower side weft. Lower side wefts each has a design in which it passes over two warps on the lower side which are adjacent to each other and passes under six successive warps on the lower side to form a weft long crimp on the lower side surface.

The fabric has two different warp designs disposed alternately on the upper side surface. Warps 1, 3, 5 and 7 on the upper side each has a 2/2 design in which passing over two upper side wefts and under two upper side wefts is repeated and warps 2, 4, 6 and 8 on the upper side each has a 1/1 design in which passing over an upper side weft and under an upper side weft is repeated.

In this Example, warp binding yarns forming a pair have the same design. By using them in combination, the 1/1 design and 3/1 design are formed on the upper side surface and lower side surface, respectively. In addition, by employing the same design for warp binding yarns 2A and 2B, dent depths of the intersections between warp binding yarns forming a pair can be made uniform.

The industrial two-layer fabric according to the present invention does not easily transfer wire marks of the fabric to paper, has enough wear resistance, rigidity, fiber supporting property, production yield of paper, water drainage property, size stability and running stability permitting preferable use even under severe environments, and can be used for a long period of time while providing good conditions necessary for paper manufacture even at the end stage of the manufacture.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. An industrial two-layer fabric comprising an upper side surface and a lower side surface, the fabric further comprising pairs of warps each obtained by vertically stacking an upper side warp to be woven with an upper side weft and a lower side warp to be woven with a lower side weft;

wherein at least one of the pairs of the warps is a binding warp pair composed of two warp binding yarns to be woven with both the upper side weft and the lower side weft to constitute a portion of an upper side surface design of the upper side surface and a portion of a lower side surface design of the lower side surface;

wherein, in a repeating unit, the lower side surface is formed by weaving the binding warp pair or the binding warp pair and the lower side warp, with the lower side wefts, the lower side surface design comprises two or three lower side surface warp designs different from each other, and wherein, in a weft design of the repeating unit, the lower side weft passes over two adjacent warps which are the two lower side warps or the lower side warp and the warp binding yarn, and then passes under a plurality of the warps that form the lower side surface, whereby forming a long crimp on the lower side surface.

2. The industrial two-layer fabric according to claim 1, wherein the warp binding yarns of the binding warp pair appear alternately on the upper side surface and are woven with the respective upper side wefts, which are different from each other, to cooperatively function as one warp constituting the upper side surface design, while on the lower side surface, the warp binding yarns of the binding warp pair appear alternately on the lower side surface and are woven with the respective lower side wefts which are different from each other.

3. The industrial two-layer fabric according to claim 1, wherein, under a first place where a first warp binding yarn of the binding warp pair is woven with one of the upper side wefts, a second warp binding yarn of the binding warp pair is woven with at least one of the lower side wefts, while, above a second place where the first warp binding yarn is woven with at least one of the lower side wefts, the second warp binding yarn is woven with one of the upper side wefts; wherein the first and second warp binding yarns complement each other to constitute an upper and lower side surface warp design formed by the pair of the upper side warp and the lower side warp.

4. The industrial two-layer fabric according claim 1, wherein each of the warp binding yarns has a warp binding yarn design which is bilaterally symmetrical relative to one or two lower side knuckles each formed by passing of the warp binding yarn under one or two of the lower side wefts and, the warp binding yarn design on the lower side surface is obtained by the warp binding yarn that passes under one or two of the lower side wefts and passes over one or more of the lower side wefts.

5. The industrial two-layer fabric according to claim 1, wherein each of the warp binding yarns of the binding warp pair has a warp binding yarn design, wherein the warp binding yarn designs of the binding warp pair are identical or in a mirror image.

6. The industrial two-layer fabric according to claim 1, wherein, in the repeating unit, the lower side surface formed cooperatively by the binding warp pair has a 3/1 warp design in which each of the warp binding yarns of the binding warp pair passes over three lower side wefts and then passes under one lower side weft alternately; and a lower side weft design constituting the lower side surface is that each one of the lower side wefts passes over the two warps of the lower side surface and then passes under six successive warps of the lower side surface.

7. The industrial two-layer fabric according to claim 6, wherein, in the repeating unit, the two different warp designs on the lower side surface comprise a 4/1-2/1 design, in which the warp passes over four lower side wefts, passes under one lower side weft, passes over two lower side wefts and passes under one lower side weft, and a 3/1 design, in which the warp passes over three lower side wefts and passes under a lower side weft, while a weft design is one in which the lower side weft passes over two successive warps on the lower side surface and then passes under six successive warps on the lower side surface.

8. The industrial two-layer fabric according to claim 6, wherein, in the repeating unit, the three different warp designs on the lower side surface comprise a 4/1-2/1 design, in which the warp passes over four lower side wefts, passes under one lower side weft, passes over two lower side wefts and passes under one lower side weft, a 3/1 design, in which the warp passes over three lower side wefts and passing under one lower side weft, and a 5/1-1/1 design, in which the warp passes over five lower side wefts, passes under one lower side weft, passes over one lower side weft and passes under one lower side weft, while a weft design is one in which the lower side weft passes over two successive warps on the lower side surface and then passes under six successive warps on the lower side surface.

9. The industrial two-layer fabric according to claim 1, wherein, in the repeating unit, the warp design on the lower side formed cooperatively by the binding warp pair is a 4/1 design in which the warp passes over four lower side wefts and then passing under one lower side weft, while the lower side weft design forming the lower side surface is one in which the lower side weft passes over two successive warps on the lower side warps and then passes under eight successive warps on the lower side surface.

10. The industrial two-layer fabric according to claim 9, wherein the two different warp designs on the lower side surface are a 6/1-2/1 design, in which the warp passes over six lower side wefts, passes under one lower side weft, passes over two lower side wefts and passes under one lower side weft, and a 4/1 design, in which the warp passes over four lower side wefts and passes under one lower side weft, while the weft design is one in which the lower side weft passes over two successive warps on the lower side surface and then passes under eight successive warps on the lower side surface.

11. The industrial two-layer fabric according to claim 1, wherein the binding warp pair is sandwiched between the pairs of warps.

12. The industrial two-layer fabric according to claim 1, wherein on the lower side surface, two warps adjacent to each other weave the lower side weft from the lower side, whereby the lower side weft forms a weft long crimp corresponding to a plurality of warps on the lower side surface, and wherein all the warps forming the lower side surface include first, second, and third warps, the second warp being located next to the first warp on one side of the first warp, and the third warp being located next to the first warp on the other side of the first warp, wherein the first, second, and third warps form a zigzag arrangement in which a first warp is shifted toward the second warp at a first point where the first and second warps weave a first lower side weft from the lower side, and the first warp is shifted toward the third warp at a second point where the first and third warps weave a second lower side weft from the lower side, alternately.

13. The industrial two-layer fabric according to claim 1, wherein the upper side surface design formed by weaving of the warp binding yarns and the upper side warps with the upper side wefts is composed of a single warp design.

14. The industrial two-layer fabric according to claim 1, wherein the upper side surface design formed by weaving of the warp binding yarns and the upper side warps with the upper side wefts is obtained by alternately disposing two warp designs different from each other.

15. An industrial two-layer fabric comprising an upper side surface and a lower side surface, the fabric further comprising pairs of warps each obtained by vertically stacking an upper side warp to be woven with an upper side weft and a lower side warp to be woven with a lower side weft;

wherein at least one of the pairs of the warps is a binding warp pair composed of two warp binding yarns to be woven with both the upper side weft and the lower side weft to constitute a portion of an upper side surface design of the upper side surface and a portion of a lower side surface design of the lower side surface;

wherein the lower side surface is formed by weaving the warp binding yarns and the lower side warps with the lower side wefts, the lower side surface design comprises two or three lower side surface warp designs different from each other and a weft design in which, in a repeating unit, the lower side weft passes over two adjacent warps which are the two lower side warps or the lower side warp and the warp binding yarn, and then passes under a plurality of the warps that form the lower side surface, whereby forming a long crimp on the lower side surface, and wherein, in the repeating unit, the lower side surface formed cooperatively by the binding warp pair has a 3/1 warp design in which each of the warp binding yarns of the binding warp pair passes over three lower side wefts and then passes under one lower side weft alternately; and a lower side weft design constituting the lower side surface is that each one of the lower side wefts passes over the two warps of the lower side surface and then passes under six successive warps of the lower side surface.

16. The industrial two-layer fabric according to claim 15, wherein, in the repeating unit, the two different warp designs on the lower side surface comprise a 4/1-2/1 design, in which the warp passes over four lower side wefts, passes under one lower side weft, passes over two lower side wefts and passes under one lower side weft, and a 3/1 design, in which the warp passes over three lower side wefts and passes under a lower side weft, while a weft design is one in which the lower side weft passes over two successive warps on the lower side surface and then passes under six successive warps on the lower side surface.

17. The industrial two-layer fabric according to claim 15, wherein, in the repeating unit, the three different warp designs on the lower side surface comprise a 4/1-2/1 design, in which the warp passes over four lower side wefts, passes under one lower side weft, passes over two lower side wefts and passes under one lower side weft, a 3/1 design, in which the warp passes over three lower side wefts and passing under one lower side weft, and a 5/1-1/1 design, in which the warp passes over five lower side wefts, passes under one lower side weft, passes over one lower side weft and passes under one lower side weft, while a weft design is one in which the lower side weft passes over two successive warps on the lower side surface and then passes under six successive warps on the lower side surface.

18. An industrial two-layer fabric comprising an upper side surface and a lower side surface, the fabric further comprising pairs of warps each obtained by vertically stacking an upper side warp to be woven with an upper side weft and a lower side warp to be woven with a lower side weft;

wherein at least one of the pairs of the warps is a binding warp pair composed of two warp binding yarns to be woven with both the upper side weft and the lower side weft to constitute a portion of an upper side surface design of the upper side surface and a portion of a lower side surface design of the lower side surface;

wherein the lower side surface is formed by weaving the warp binding yarns and the lower side warps with the lower side wefts, the lower side surface design comprises two or three lower side surface warp designs different from each other and a weft design in which, in a repeating unit, the lower side weft passes over two adjacent warps which are the two lower side warps or the lower side warp and the warp binding yarn, and then passes under a plurality of the warps that form the lower side surface, whereby forming a long crimp on the lower side surface, and wherein, in the repeating unit, the warp design on the lower side formed cooperatively by the binding warp pair is a 4/1 design in which the warp passes over four lower side wefts and then passing under one lower side weft, while the lower side weft design forming the lower side surface is one in which the lower side weft passes over two successive warps on the lower side warps and then passes under eight successive warps on the lower side surface.

19. The industrial two-layer fabric according to claim 18, wherein the two different warp designs on the lower side surface are a 6/1-2/1 design, in which the warp passes over six lower side wefts, passes under one lower side weft, passes over two lower side wefts and passes under one lower side weft, and a 4/1 design, in which the warp passes over four lower side wefts and passes under one lower side weft, while the weft design is one in which the lower side weft passes over two successive warps on the lower side surface and then passes under eight successive warps on the lower side surface.

* * * * *